US009328580B2

(12) United States Patent
Tinnen

(10) Patent No.: US 9,328,580 B2
(45) Date of Patent: May 3, 2016

(54) EQUALIZED HYDROSTATIC BAILER

(71) Applicant: Bard Martin Tinnen, Stavanger (NO)

(72) Inventor: Bard Martin Tinnen, Stavanger (NO)

(73) Assignee: Atlus Intervention AS, Stavanger (NO)

( * ) Notice: Subject to any disclaimer, the term of this patent is extended or adjusted under 35 U.S.C. 154(b) by 78 days.

(21) Appl. No.: 14/353,415

(22) PCT Filed: Nov. 7, 2012

(86) PCT No.: PCT/NO2012/050215

§ 371 (c)(1),
(2) Date: Apr. 22, 2014

(87) PCT Pub. No.: WO2013/073948

PCT Pub. Date: May 23, 2013

(65) Prior Publication Data

US 2014/0262299 A1 Sep. 18, 2014

(30) Foreign Application Priority Data

Nov. 14, 2011 (NO) ..... 20111557

(51) Int. Cl.
*E21B 27/00* (2006.01)
*E21B 27/02* (2006.01)

(52) U.S. Cl.
CPC ..... *E21B 27/00* (2013.01); *E21B 27/02* (2013.01)

(58) Field of Classification Search
CPC ..... E21B 27/00; E21B 37/00; E21B 27/005; E21B 27/04
See application file for complete search history.

(56) References Cited

U.S. PATENT DOCUMENTS 5,135,050 A * 8/1992 Tailby ..... E21B 27/00 166/311

FOREIGN PATENT DOCUMENTS

NO 330997 B1 9/2011
WO 2009153560 A2 12/2009

* cited by examiner

*Primary Examiner* — Zakiya W Bates
(74) *Attorney, Agent, or Firm* — Gable Gotwals

(57) ABSTRACT

This invention relates to an apparatus and a method for collecting debris in a wellbore. The apparatus includes a housing for receiving debris defined by an endless wall portion, first and second end portions, at least the second end portion is provided with at least one closable aperture allowing one-way flow of debris into the housing, a releasable sealing device for holding a volume of a first fluid within the housing, the volume of the first fluid having a lower pressure than ambient wellbore pressure; a retaining device for initially holding the releasable sealing device in a first portion; a releasable sealing device to move from the first position to a second position, whereby debris is entered through the closable aperture into the housing, where volume of first fluid is reduced, at least one conduit defined by an inlet and an outlet, the outlet being in the second end portion being submerged in the debris when the apparatus collects debris, the inlet in fluid communication with a pressurized second fluid contained in a chamber upon release of a valve.

16 Claims, 28 Drawing Sheets

EQUALIZED HYDROSTATIC BAILER

CROSS-REFERENCE TO RELATED APPLICATIONS

This United States National Phase of PCT Application No. PCT/NO2012/050215 filed 7 Nov. 2012 claims priority to Norwegian Patent Application No. 20111557 filed 14 Nov. 2011, each of which are incorporated herein by reference.

BACKGROUND OF THE INVENTION

This invention relates to an equalized debris bailer system for wells related to production of hydrocarbons.

In conjunction with constructing, completing, operating and maintaining wells, there is a potential for experiencing situations where debris accumulates and causes problems.

One example is debris that accumulates on top of barriers that are to be retrieved, preventing the pulling tools from engaging relevant fishing necks. Such debris could be the result of particle production from the reservoir, or a result of heavy particles settling out from a heavy fluid, such as drilling mud. In other situations, such as a recompletion operation, debris could be formed by scale or rust or other components and/or by particles falling off the old production tubing during the retrieval process. Other examples include steel cuttings from milling or cutting operations, grease that has been applied on the pipe threads of the production tubing, lost objects and more.

Another example of debris accumulation is related to deviated and horizontal wells. If the well production flow velocity is too slow to produce particles out of the well, these particles tend to settle and accumulate at particular locations in the well. Typically, debris will settle in a section of the well characterized by a certain angle of deviation. Upstream of this location, the flow velocity may be sufficient to transport the particles, but downstream of the location—typically where the well angle becomes steeper—the flow velocity is insufficient for lifting the particles out of the well. In such cases, there is a risk of relatively long dunes or accumulations being formed in the well. In worst case, such debris accumulation may potentially reduce production or even plug the well. In any case, such dunes represent a problem for wireline interventions, preventing the deployment of tools to locations below the debris or, in the worst case, causing the toolstring to become stuck in the well.

The term "bailer" is a common term for devices used to collect and bring debris out of the well. There is a variety of types. Features in common are a collector pipe for housing the gathered debris; a triggering mechanism for initiating and conducting the collection of debris; and a bottom valve/closure mechanism to prevent the debris from exiting the collector pipe during retrieval of the bailer from the well after being filled.

Typical closure mechanisms for bailers comprise flapper valves, poppet valves, and ball valves.

Pump bailers are operated by means of wireline. After landing the bailer in the debris column, the wireline is pulled up. For this type of bailer, the upper part of the downhole toolstring is connected to a shaft being connected to an inner piston of the bailer. When pulling up, this inner piston is shifted upwards, which causes debris to be sucked into the lower end of the bailer. A potential drawback is that a relatively limited suction force is generated.

Other known pump-based bailer systems are operated by electric pumps. Here, the well fluid is circulated through the system. More specifically, the well fluid is routed through the collector pipe by means of the pump. The fluid exit is provided with a screen that ensures that the debris is kept within the collector pipe. Potential drawbacks with this type of bailer are a somewhat limited suction force, and also that the bailer might not be properly filled should the screen experience premature plugging.

One alternative to the pump-based bailer systems are bailers that apply transport screws to collect and bring the debris into the collector pipe. One limitation of screw bailers is that they may not be able to remove debris located on the outside of external fishing necks (i.e. once the screw meets a steel object, no more debris can be collected).

Another family of bailer concepts is hydrostatic bailers. In a hydrostatic bailer, the collector pipe contains air being at atmospheric pressure when running into the well. After landing the bailer in the debris column, a piston is released. Initially, this piston is located at the bottom end of the collector pipe and, upon being released, the piston travels towards the upper end of the collector pipe. Because of the rear end of the piston being exposed to air at atmospheric pressure, a tremendous suction force is created at the inlet of the bailer.

Hydrostatic bailers can be capable of collecting debris located in areas where other bailer systems cannot gain access, and also of collecting debris being of such a nature that other bailers cannot collect it (for instance partly hardened debris). Despite these benefits, the industry is somewhat reluctant to use hydrostatic bailers. The reason for this is that they tend to get stuck in the well. More precisely, in some situations the bailer is sucked down into the debris column where the debris forms a pressure tight mudcake around it, thereby preventing the underpressurised collector chamber from being fully pressure-equalized with the rest of the well. As a result, the bailer sticks and cannot be retrieved without applying excessive force on the wireline, causing damage to or breaking the wireline.

Publication NO 330997 discloses a cleaning tool for use in a borehole where the cleaning tool comprises a collection volume, and where an actuator in the cleaning tool is disposed to be able to reduce an in the cleaning tool being flushing liquid volume, as a discharging flushing liquid from the flushing liquid volume is led through a jet pod and directed towards an object to be cleaned.

Publication WO 2009/153560 A2 discloses an apparatus for creating a force downhole. The apparatus comprises a tubular body defining a chamber, a plug, the plug being movable between a first position at a first chamber location to a second position at a second chamber location, a latch adapted to releasably fix the plug in the first position and a latch mechanism to release the latch.

The object of the present invention is to remedy or reduce at least one of the drawbacks of prior art.

The object is achieved in accordance with the invention, by the characteristics stated in the description below and in the subsequent claims.

According to a first aspect of the present invention there is provided an apparatus for collecting debris in a wellbore, the apparatus comprising:

- a housing for receiving debris, the housing being defined by an endless wall portion, a first end portion and a second end portion, at least the second end portion being provided with at least one closable aperture allowing one-way flow of debris into the housing;
- a releasable sealing device for holding a volume of a first fluid within the housing, the volume of the first fluid having a lower pressure than the ambient wellbore pressure;

a retaining device for initially holding the releasable sealing device in a first position;

a release mechanism for operating the retaining device in a manner allowing the releasable sealing device to move from the first position to a second position, whereby debris is entered through the closable aperture into the housing, whereupon said volume of first fluid is reduced, wherein the apparatus is further provided with at least one conduit extending between the end portions of the apparatus, the conduit being configured to communicate wellbore fluid from the first end portion to the second end portion to equalize any pressure differential between the end portions.

As an alternative to equalizing any pressure differential between the end portions by means of the wellbore fluid, the present invention is related to an apparatus for collecting debris in a wellbore, the apparatus comprising:

a housing for receiving debris, the housing being defined by an endless wall portion, a first end portion and a second end portion, at least the second end portion being provided with at least one closable aperture allowing one-way flow of debris into the housing;

a releasable sealing device for holding a volume of a first fluid within the housing, the volume of the first fluid having a lower pressure than the ambient wellbore pressure;

a retaining device for initially holding the releasable sealing device in a first position;

a release mechanism for operating the retaining device in a manner allowing the releasable sealing device to move from the first position to a second position, whereby debris is entered through the closable aperture into the housing, whereupon said volume of first fluid is reduced, wherein the apparatus is further provided with at least one conduit defined by an inlet and an outlet, the outlet being in the second end portion being submerged in the debris when the apparatus is in a position for collecting debris, the inlet being in fluid communication with a pressurised second fluid contained in a chamber, the second fluid having a pressure exceeding an ambient pressure so that, upon release of a valve the pressurized second fluid flows out of the outlet.

The first aspect of the invention and the alternative above have the effect that any underpressure generated in the first and/or second chamber after release of the releasable sealing device, will be pressure equalized with the second fluid even if the debris has created a fluid-tight seal around a lower portion of the bailer. Thus, the bailer according to the present invention provide a pressure equalized hydrostatic bailer that substantially removes the drawbacks of prior art hydrostatic bailers, and thus facilitates retrieval of the bailer containing debris. Even in the case where no underpressure has been generated in the first and/or second chamber after release of the piston, the pressure equalising conduit may represent a significant improvement to existing solutions. The reason is that a normal bailer operation very often entails the bailer being sucked substantially into the debris column. It is commonly experienced that because of this, even in the case where no underpressure has been formed in the first and/or second chamber, it may be difficult to retrieve the bailer. The reason is related to underpressure forming at the first portion of the bailer (i.e. the end that has been sucked the furthest into the debris) as a function of retrieving it, resulting in a suction force. Often, the nature of this effect is that the harder the wireline pull, the larger this suction force becomes. The equalisation conduit according to the present invention will allow for a pressurized fluid to flow to a location close to the first portion of the bailer, hence fill the volume or "cavity" created when pulling the bailer with pressurised fluid from the wellbore, and the bespoken suction force will be significantly dampened or eliminated.

In one embodiment the second end portion comprises the releasable sealing device, and the aperture is defined by the sealing device.

In a preferred embodiment the releasable sealing device is a piston arranged within the housing, the piston defining at least a first chamber within the housing, and a second chamber being in fluid communication with the closable aperture.

The pressure in the second chamber may be higher than the pressure in the first chamber whereby upon operating of the release mechanism, the piston is allowed to move towards the second end portion and allow debris to be moved through the aperture into the first chamber.

In one embodiment the at least one conduit is provided in the wall portion.

As mentioned above, the inlet portion of the conduit may be in fluid communication with a chamber containing the pressurized second fluid which is arranged to be released upon release of a valve. Alternatively, the conduit extends through the end portions of the apparatus, where the pressurized second fluid is a wellbore fluid.

The conduit may be provided with means arranged in a lower portion of the conduit, whereby debris is prevented from entering into the conduit upon running the apparatus into the debris. The means may be a one-way valve.

According to a second aspect of the present invention, there is provided a method for facilitating retrieval of a hydrostatic bailer arranged for collecting debris in a wellbore, wherein the method comprises allowing pressurized fluid to flow out of a lower portion of the apparatus and into the debris, which at least reduces any underpressure generated during at least one of a debris collection process and an apparatus retrieval process from the well.

As indicated earlier, there are two distinct beneficial aspects associated with the method. The first beneficial aspect is that underpressure, which is created during activation and operation of the hydrostatic bailer, will be eliminated or reduced. The second beneficial aspect is that underpressure, which is created as part of the process dynamics when pulling the bailer out of the debris columns, is eliminated or reduced.

The following describes a non-limiting example of a preferred embodiment illustrated in the accompanying drawings, in which.

Figure 5:
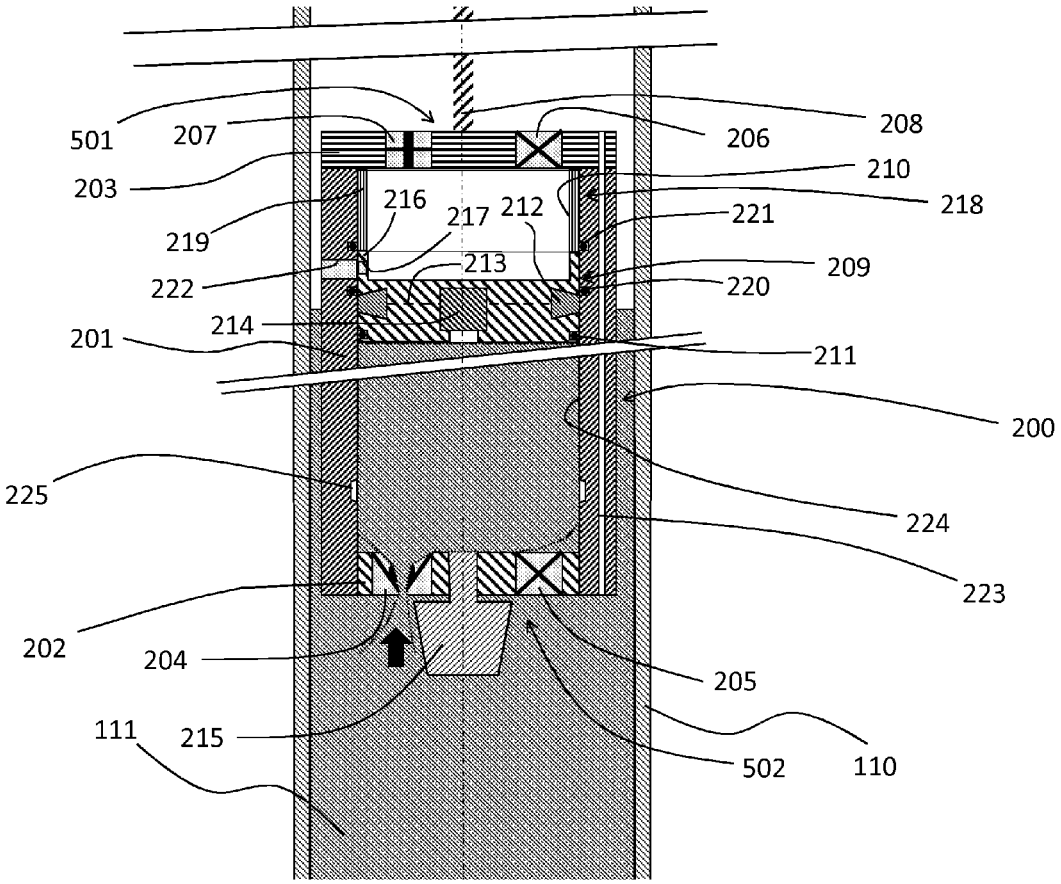
FIG. 5-6 illustrates further steps of the debris collection operation.
Figure 6:
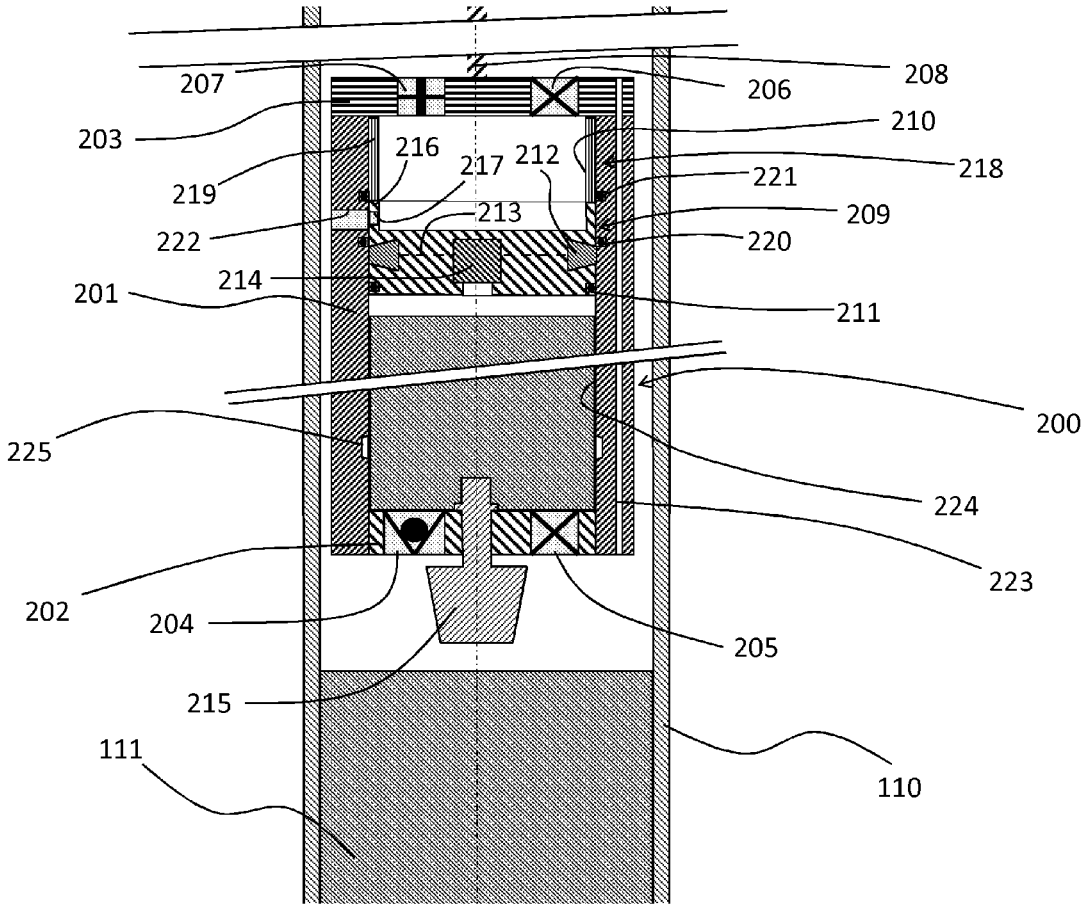
Figure 7A:
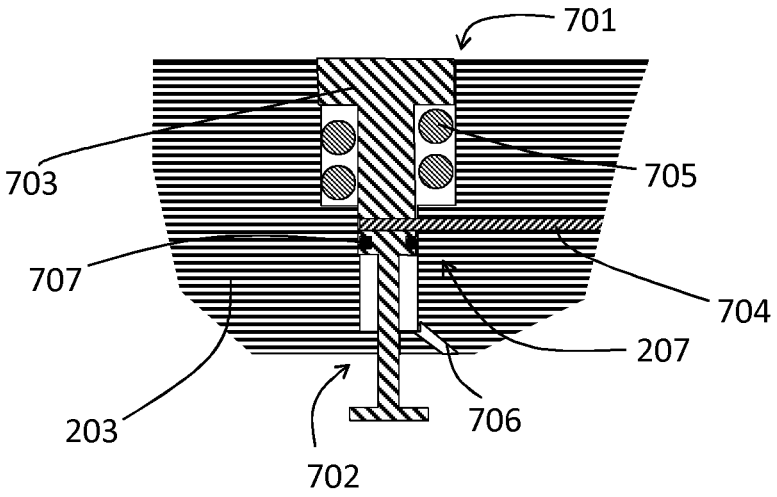
Figure 7B:
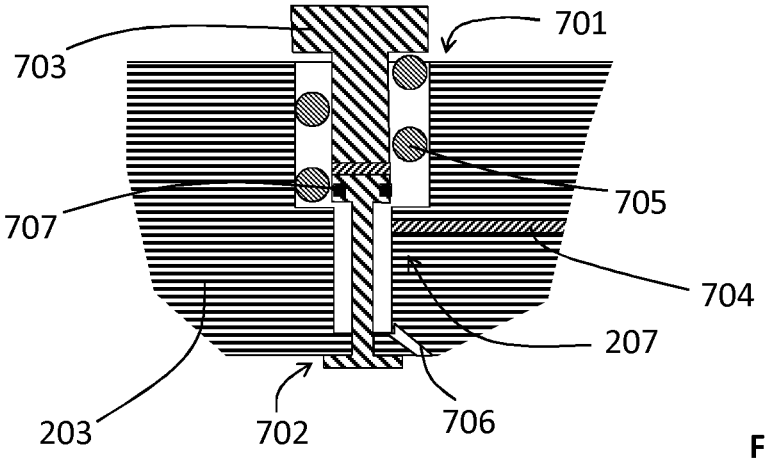
Figure 8:
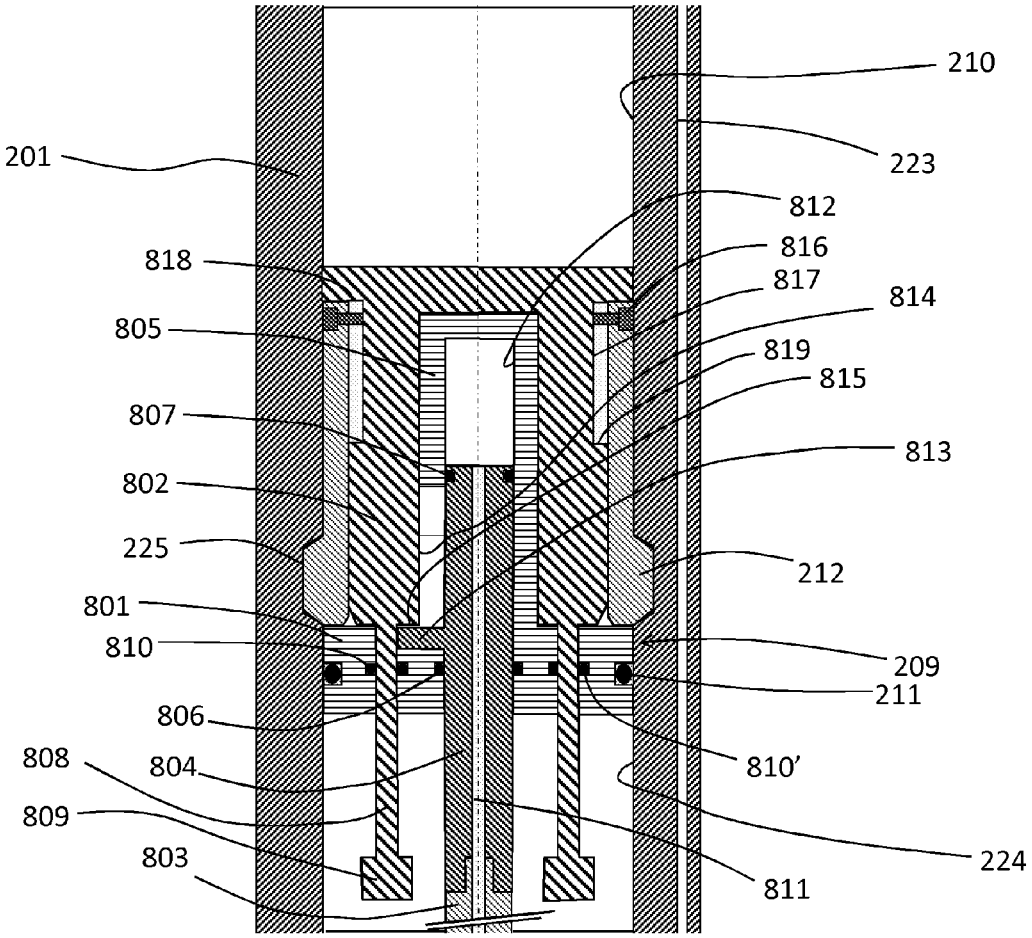
Figure 13:
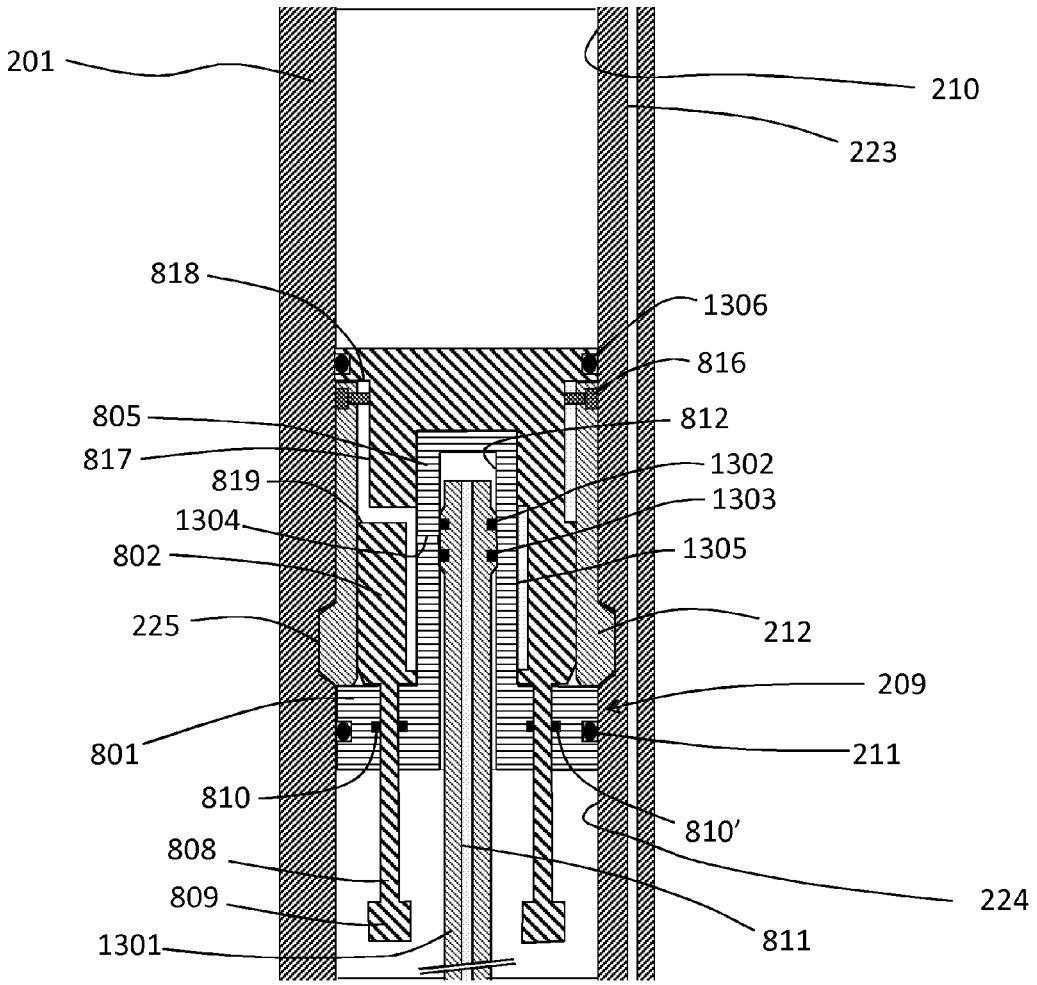
Figure 18:
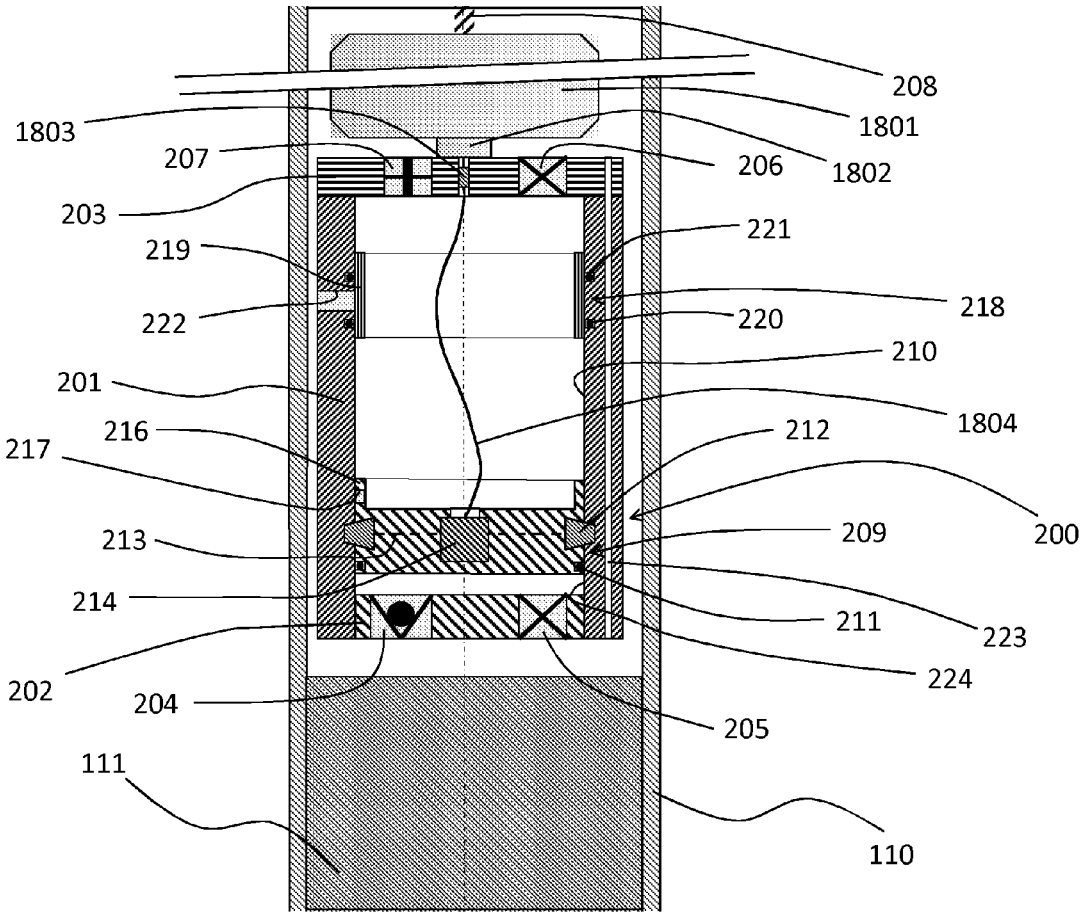
Figure 19:
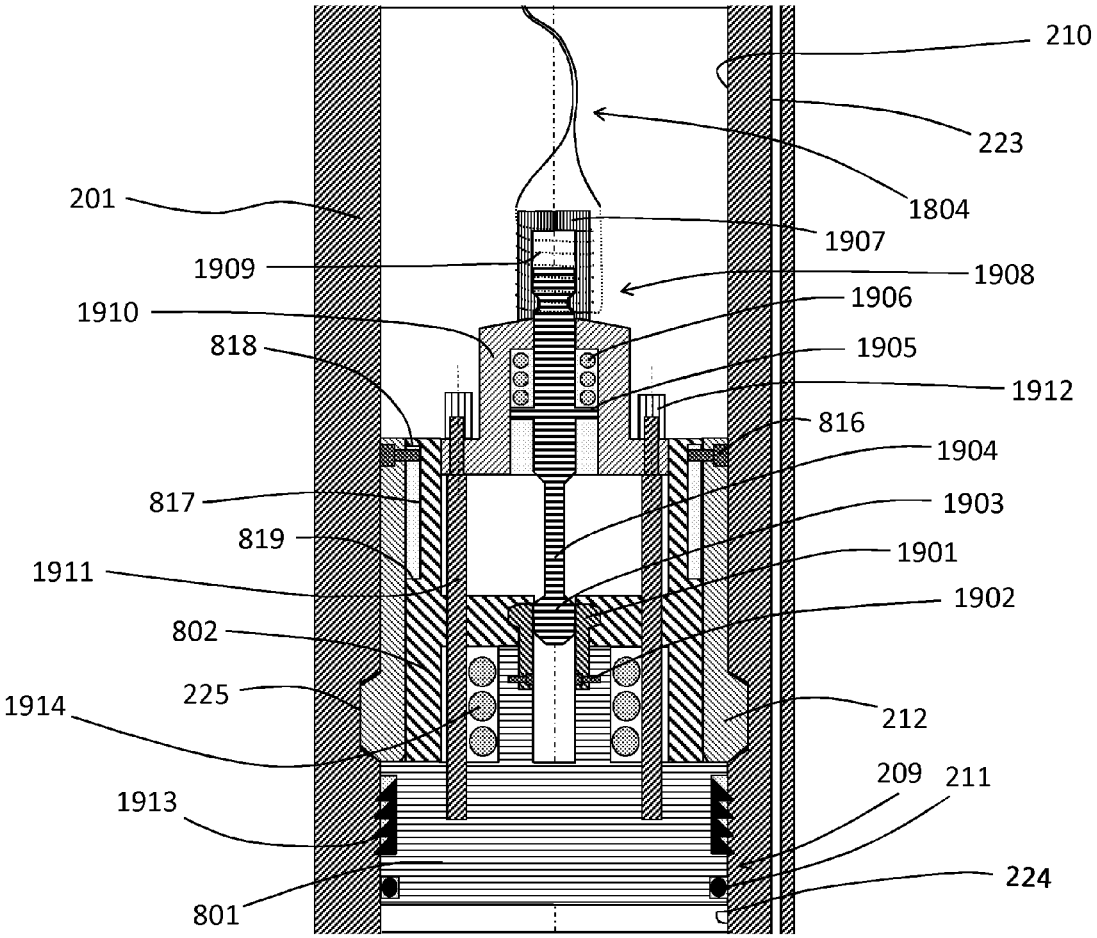
Figure 24:
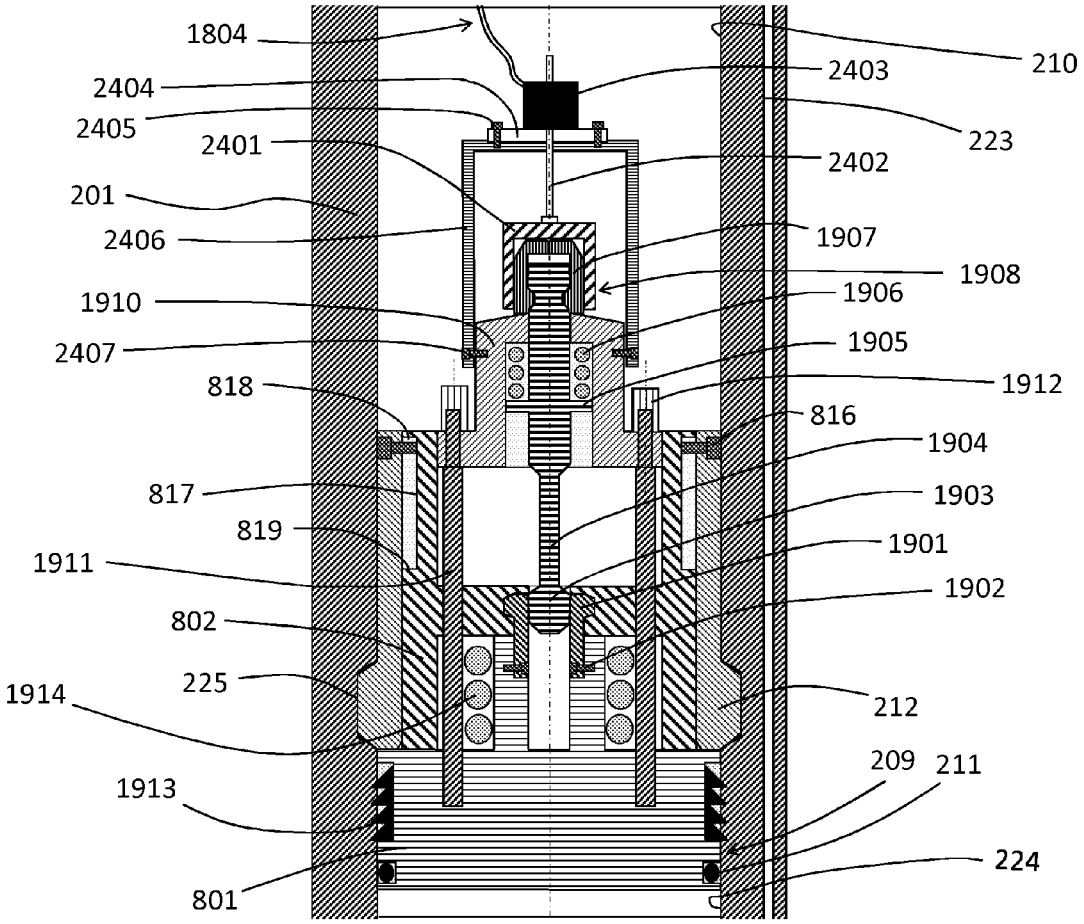
Figure 25:
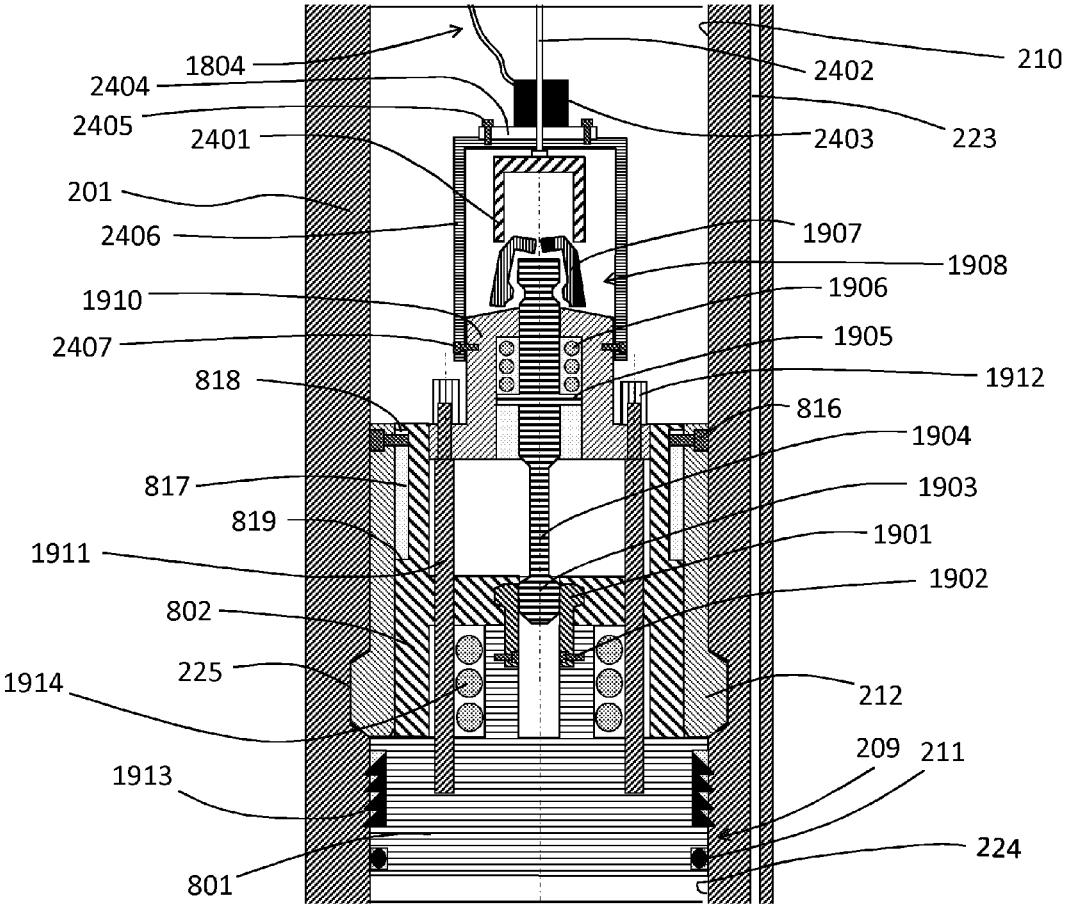
Figure 26:
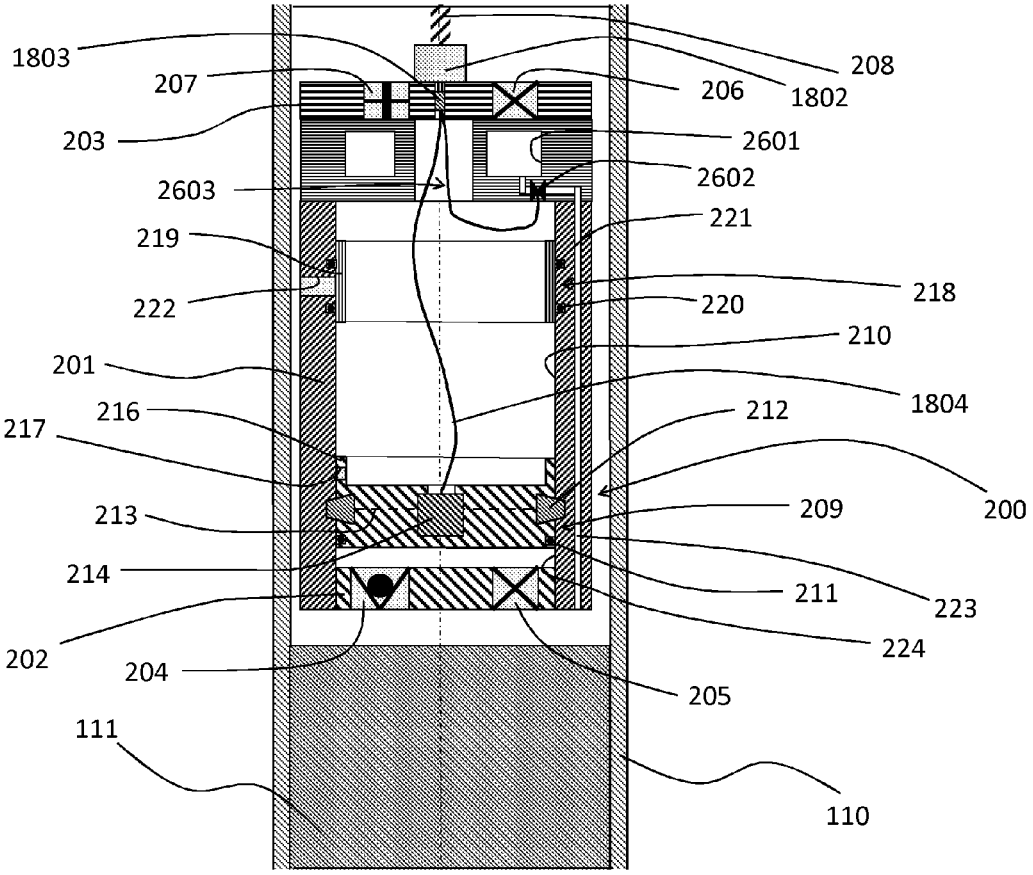

FIGS. 7*a* and 7*b* illustrate one embodiment of an automatic pressure relief valve suitable for use in a top flange of the bailer shown in FIGS. 3-6;

FIG. 8 illustrates another embodiment of a bailer piston suitable for use in the bailer;

FIGS. 9-12 illustrate operational steps for the embodiment in FIG. 8;

FIG. 13 illustrates a further alternative embodiment of the bailer piston;

FIGS. 14-17 illustrate steps of operating the system according to the embodiment shown in FIG. 13;

FIG. 18 illustrates yet another embodiment of the bailer according to present invention, where the bailer is run into the well on a wireline tractor, and where the bailer is provided with electrical activation means;

FIG. 19 illustrates an example of the present invention, where the bailer is provided with means for electrical activation;

FIGS. 20-23 illustrate steps of operation electrical activation;

FIG. 24 illustrates a bailer according to the present invention, where the bailer is provided with a motor activating means;

FIG. 25 illustrates an initial step of operating the bailer in FIG. 24; and FIG. 26 illustrates an embodiment where gas at high pressure is routed into a conduit when activating the bailer.

Figure 27:
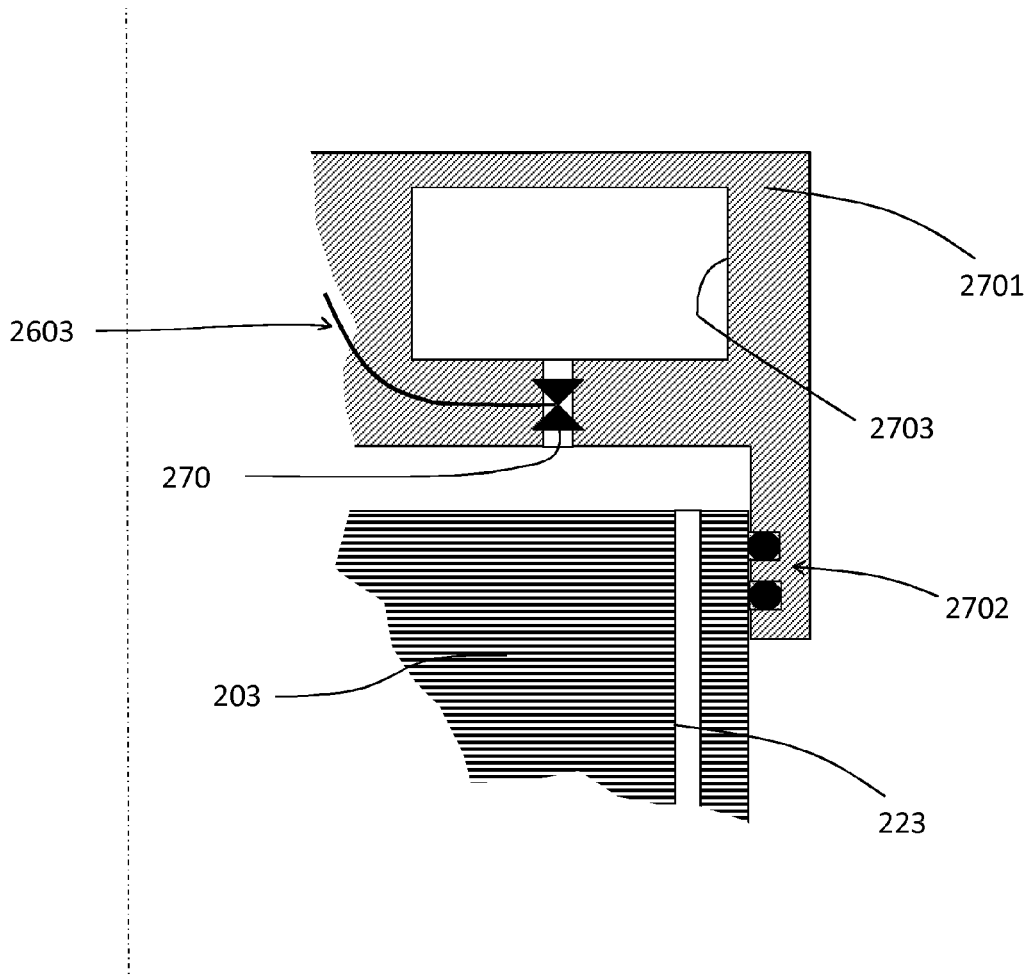

FIG. 27 illustrates, in larger scale, a top portion of a bailer being engaged by a fishing tool containing fluid at high pressure used for retrieval of an accidentally stuck bailer.

Figure 28A:
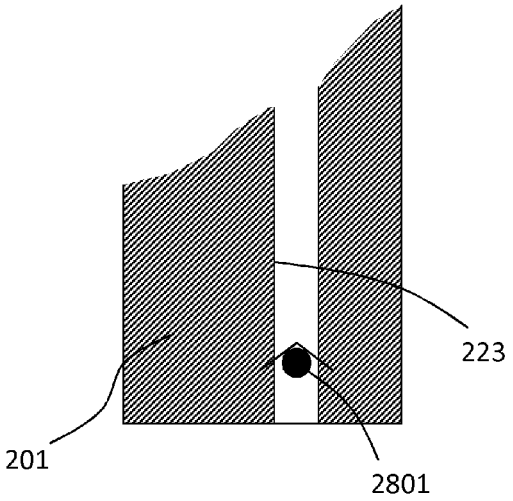
Figure 28B:
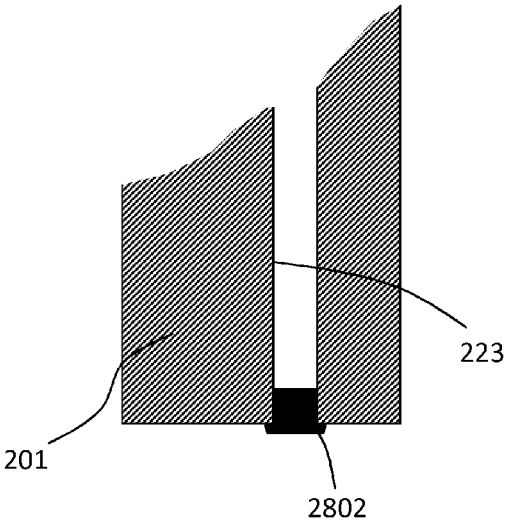

FIGS. 28*a* and 28*b* illustrates, in larger scale, a lower portion of the equalizing conduit provided with means for preventing the conduit from becoming accidentally plugged during deployment and operation in the well.

In the figures, similar or corresponding parts may be indicated by the same reference numerals.

Positional indications such as e.g. upper, lower, above, below, and also directions such as upwards and downwards, refer to the position shown in the figures.

Figure 1:
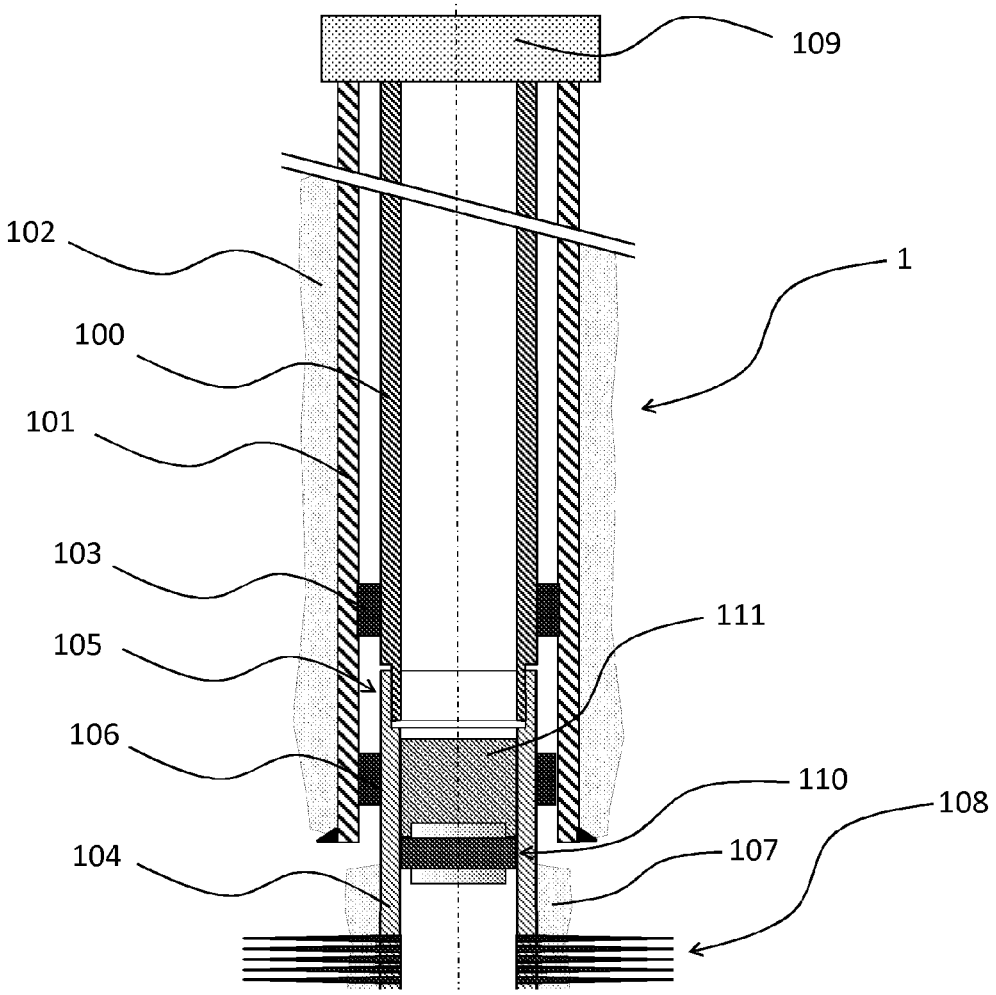
FIG. 1 illustrates a generic well.

FIG. 1 illustrates a generic well 1 which is used in the subsequent illustrating examples. As can be seen in the figure, the well comprises a production tubing 100 that is run inside a production casing 101. The production casing is fixed to the surrounding rock formation by an outer cement section 102. The cement also provides a barrier seal in an annular cavity between the production casing 101 and the surrounding rock formation. A production packer 103 forms a seal in the annulus between the tubing 100 and the casing 101.

The production tubing 100 is inserted or stung into a production liner 104 via a so-called stinger assembly 105. The annulus between the liner 104 and the casing 101 is sealed by a liner seal 106. In the embodiment shown, the liner 104 is cemented to the surrounding formation by means of a lower cement section 107. In order to provide a flow path between the wellbore and relevant sections of the surrounding formation, the well is perforated. A set of perforations 108 are illustrated.

A wellhead 109 is provided on top of the well 1. A person skilled in the art will appreciate that the wellhead 109 is connected to a flow line, but this is not illustrated herein for the sake of simplicity.

In a lower section of the well, a retrievable barrier 110 is installed. This barrier 110 could have been installed in conjunction with general maintenance work or recompletion work in the well. In this particular situation, the retrievable barrier 110 has been covered by a debris column 111. The debris may, for example, have arisen from drop-out of scale when recompleting the well, or may be generated by other actions or events in the well. As a main result, the retrievable barrier 110 cannot be accessed and engaged by relevant running tools. In order to do so, the debris must be removed.

Figure 2:
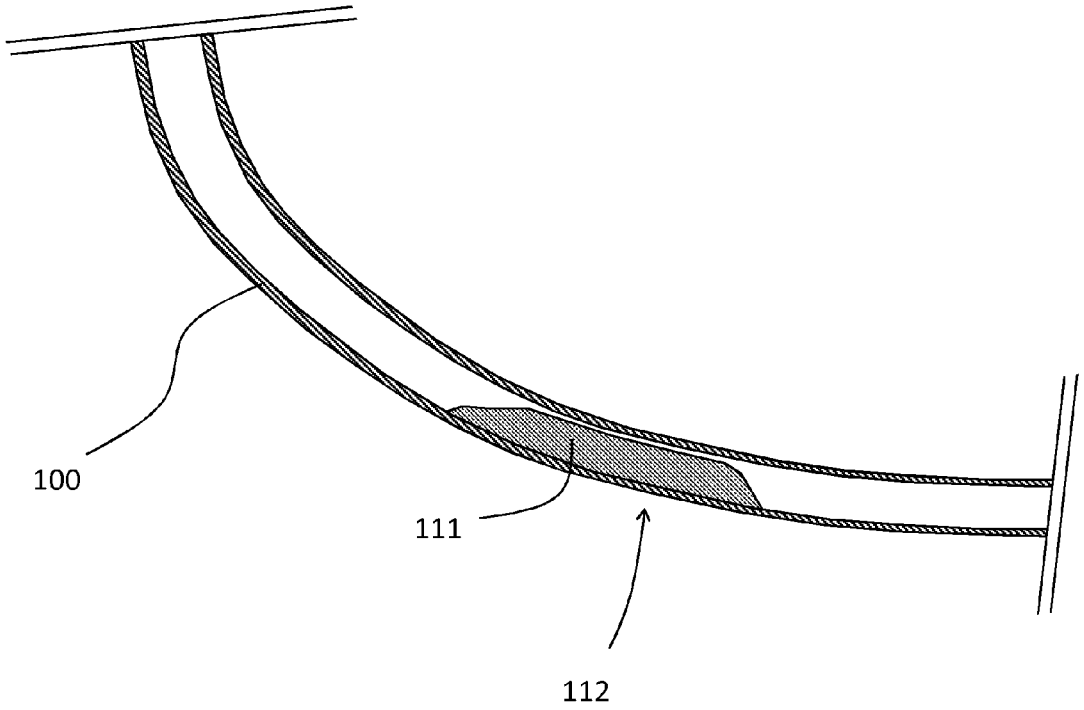
FIG. 2 illustrates a kick-off section in a well with a debris dune therein.

FIG. 2 illustrates a so-called kick-off section or heel in the well, where the well's deviation angle changes from "mainly vertical" to "mainly horizontal". Here, a debris accumulation or dune 112 has formed in an area of the production tubing 100 where the production flow rate is too low to transport the debris in the more vertically deviated section of the well, and thus further out of the well.

Figure 3:
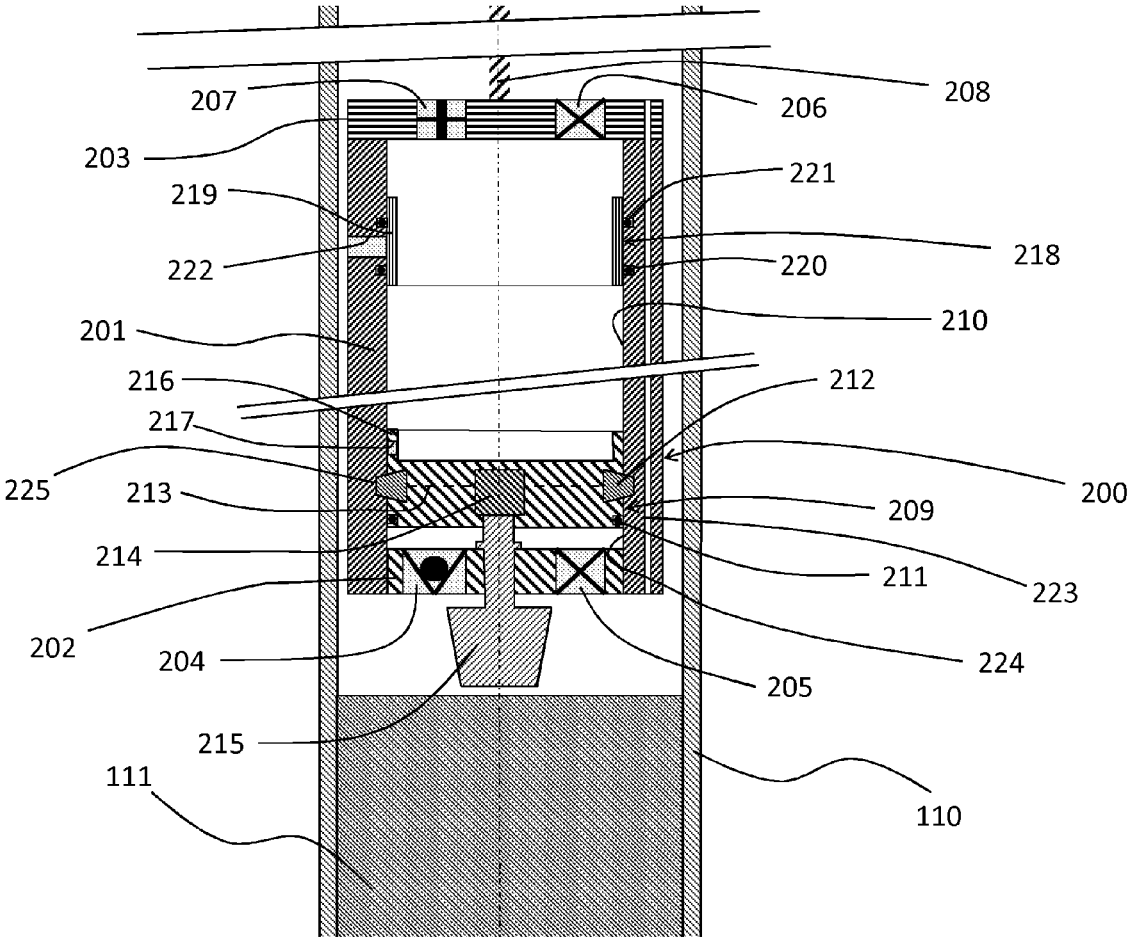
FIG. 3 illustrates a hydrostatic bailer according to the present invention.

FIG. 3 illustrates a hydrostatic bailer 200 according to the present invention. The hydrostatic bailer 200 comprises a collector pipe 201, a bottom flange 202 and a top flange 203. The bottom flange 202 comprises a closure valve 204, the purpose of which is to prevent gathered debris from exiting the bailer when being retrieved from the well after operation. The bottom flange 202 also comprises a manually-operated lower pressure bleed-off system 205. This is a safety feature used to manually bleed off any trapped overpressure in the system, which may be present after having operated it in the well.

A similar manually-operated upper pressure bleed-off system 206 is located in the top flange 203. The top flange 203 includes an automatic pressure relief valve 207, the purpose of which is to ensure that the majority of any trapped pressure is evacuated from the bailer 200 prior to being handled by any personnel. The wireline cable 208 is included for illustrating purposes.

A piston 209 is mounted in the bottom end of the bailer 200. This provides for maintaining atmospheric pressure inside a collector chamber 210 when deploying the bailer into the well. A seal section or piston seal 211 provides for the necessary pressure integrity of the piston 209. Lock profiles 212 physically lock the piston 209 to a recess 225 provided in the collector pipe 201 when the bailer 200 is in its initial position, as shown in FIG. 3.

The bailer is activated by means of a piston release system 213 causing the lock profiles 212 to disengage from the recess 225 in the collector pipe 201. For this illustrated embodiment, the release system 213 is connected to an activation mechanism 214 operated by an activation nose 215. It should be appreciated that the illustrated embodiment is only one of a variety of activation mechanisms, and that other activation mechanisms could be applied.

The activation nose 215 may be formed in many different ways. In one embodiment, the activation nose 215 is adapted to suit the consistence of the debris in question. As an example, if the debris is relatively compact, a relatively slim body activation nose 215 could be applied. If the debris is soft and muddy, the activation nose 215 could be formed in a manner allowing it to maximize the contact area with the debris, for instance by increasing the transverse area on the tip of the activation nose 215. In very soft mud, the tip could, for example, be formed into a somewhat large, convex parabolic shape in order to maximize drag/resistance when lowering the bailer 200 into the debris column 111.

The upper part of the piston 209 comprises a piston flange 216 and a piston equalizing port 217.

The top section of the bailer 200 comprises a direct equalizing system 218 which comprises an equalizing sleeve 219, lower seals 220, upper seals 221 and an equalizing port 222.

An equalizing conduit, which is shown as a line 223, provides for fluid communication between the top and the bottom of the bailer 200. The equalizing line 223 will equalize differential pressure that may arise during operation and thus prevents the bailer from getting stuck due to the presence of differential pressure.

A cavity or chamber 224 between the bottom flange 202 and the piston 209 is pressurised to a pressure being substantially equal to the surrounding wellbore pressure. However, after operating the bailer and/or during subsequent retrieval from the well, a pressure-tight mudcake may form around the main closure valve 204, which implies that pressure is trapped in the cavity 224. This is the main reason for including the lower, manually operated pressure bleed-off system 205 in the bottom flange 202. In another embodiment, the bottom flange 202 may comprise other bleed valves, such as automatic/mechanic pressure relief valves.

In the embodiment shown, the main closure valve 204 is arranged off-center with respect to the central axis of the bailer 200. Moreover, the main closure valve 204 is illustrated to be of a relatively small inner diameter (i.e. having a relatively small flow area). These embodiments have been chosen for illustrative purposes only. In other embodiments, modifications can be done in order to optimize the main closure valve 204 by means of location, geometry, design and dimensions. Such modifications will be appreciated by a person skilled in the art.

Figure 4:
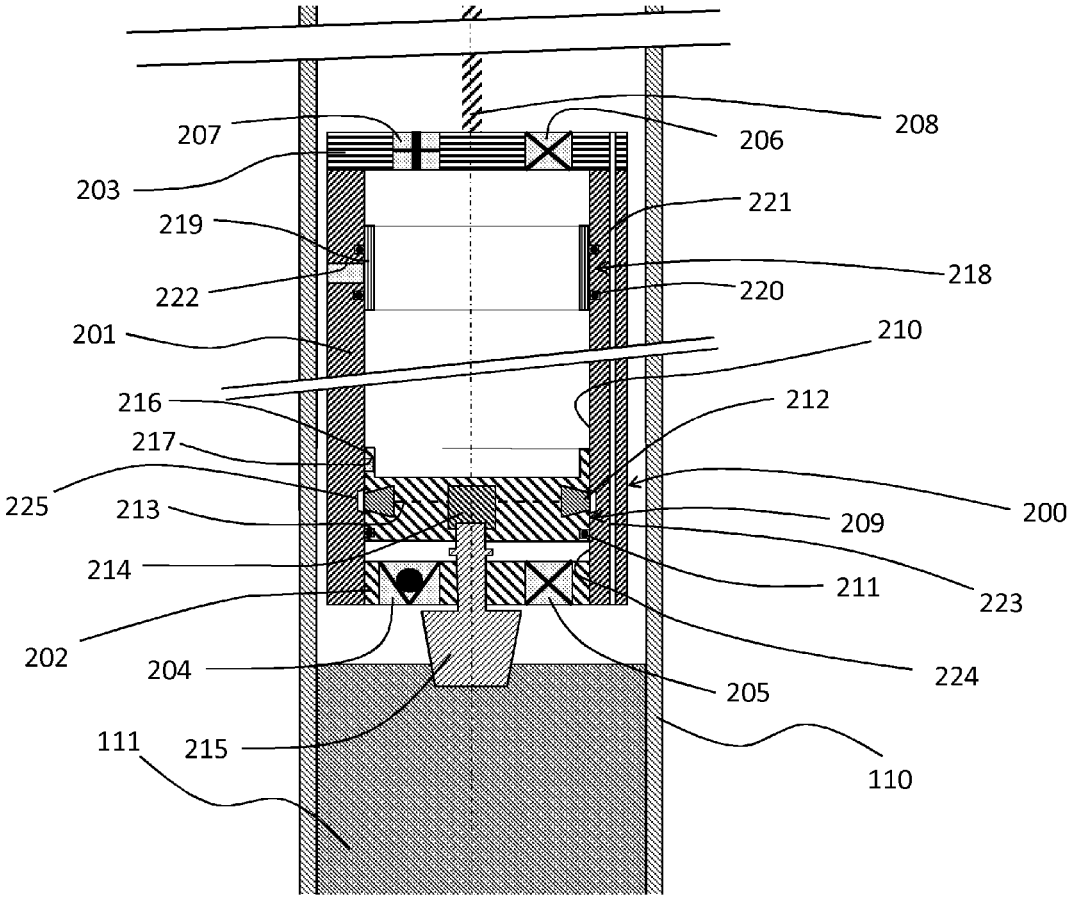
FIG. 4 illustrates an initial step of the debris collecting operation.

FIG. 4 illustrates the initial step of the debris collecting operation where the activation nose 215 is lowered into the debris column 111. The physical resistance exerted by the debris column 111 causes a push on the activation nose 215 so that it moves in an inward direction with respect to the bailer 200. This movement causes the activation nose 215 to interact with the activation mechanism 214, which in turn interacts with the release system 213 so as to cause the lock profiles 212 to disengage from a recess 225, as will be discussed further below. When the profiles 212 are disengaged from the recess 225, the piston is loose, whereby the well pressure will push the piston 209 inwards and further up into the bailer 200. When this further movement of the piston 209 occurs, parts of the debris column 111 will be sucked or driven into the collector chamber 210 of the bailer 200. This process normally takes place by virtue of the bailer 200 being sucked into the debris column 111.

FIG. 5 illustrates the situation after the piston 209 has travelled its full length in the collector chamber 201. The collector chamber 201 has now been substantially filled with debris 111. The direct equalizing system 218 has been shifted by the piston 209, and the equalizing port 222 is aligned with the piston equalizing port 217. This again has caused the collector chamber 210 to be pressure-equalized with the surrounding well pressure. This feature of pressure equalization is mainly intended to prevent pressure from becoming trapped inside the bailer upon retrieval, and which may represent a safety threat to personnel handling the bailer 200. However, the effect of operating the direct equalising system 218 may also contribute to reduce and/or avoid underpressure forming in the lower sections of the bailer 200 after activation.

Due to the main closure valve 204 combined with any mudcake that may form in the bottom section of the bailer, the direct equalizing system 218 is not seen to be capable of eliminating underpressure forming at the very bottom of the bailer, i.e. below the main closure valve 204. In order to equalize any underpressure forming in this region, the equalizing line 223 is required.

A person skilled in the art would appreciate that the equalizing line 223 may be provided with one or more additional lines, to increase pressure-equalizing capacity. Moreover, the equalizing line 223 may be provided with one or more one-way valves or plugs to prevent accidental/premature plugging when running the tool in the well, and/or into the debris column 111. Typically, such one-way valve/plug systems would prevent debris from entering the equalizing line 223 from the lower/bottom end, and thus cause the line to plug, whereby the equalizing functionality is impaired or non-existent.

FIG. 6 illustrates retrieval of the bailer 200 after collection of the debris 111. The closure valve 204 is in the closed position and thus prevents the debris from falling out of the bailer 200 during retrieval.

FIGS. 7*a* and 7*b* illustrate, in larger scale, one embodiment of the automatic pressure relief valve 207 arranged in the top flange 203 of the bailer 200, which is shown in FIGS. 3-6. After operating the bailer 200 and during retrieval out of the well 1, the exterior 701 of the bailer 200 will be exposed to a gradually decreasing pressure. Initially, the inside 702 of the bailer 200 will hold a pressure equal to the well pressure at the relevant sample depth. As the bailer 200 is retrieved from the well, the pressure differential between the exterior 701 and the interior 702 of the bailer 200 is gradually increased.

The automatic pressure relief valve 207 comprises a piston 703, which is kept in an initial position by a shear pin 704, as shown in FIG. 7*a*. A pre-compressed spring 705 seeks to push the piston in an upwards direction, as shown. Once the pressure relief valve 207 is activated, a channel 706 provides for fluid communication between the exterior 701 and the interior 702 of the bailer 200. A seal 707 is also included.

Once the pressure differential between the exterior 701 and the interior 702 of the bailer 200 exceeds a certain level, the shear pin 704 shears off, and the piston 703 is shifted, as shown in FIG. 7*b*. There is now fluid communication from the interior 702, through the channel 706 to the exterior of the bailer 200.

As shown in FIG. 7*b*, the piston 703 is forced out of its channel when activated. This provides for a good visual verification that the pressure relief valve 207 has been activated.

It should be noted that if the direct equalizing system 218 of FIGS. 3-6 have been shifted, the pressure on the inside 702 of the bailer 200 will be automatically adjusted to the pressure on the exterior 701 of the bailer 200. The main intention with the automatic pressure relief valve 207 is to function as a replacement for the direct equalizing system 218, or as a contingency device should this fail to operate.

FIG. 8 illustrates another embodiment of a bailer piston 209 and associated activation and release systems suitable for use in the bailer 200. A main piston element 801 represents a body that holds the differential pressure when deploying the bailer 200 into the well. A piston core 802 is providing radial support to a finger coupling 212, keeping this in place in a recess 225 of a collector pipe 201 during deployment into the well 1. In the embodiment shown in FIG. 8, the main piston element 801 is directly prevented from moving into the bailer 200 by the finger coupling 212. A lower portion of a shaft 803 is connected to the activation nose 215, which is shown in FIGS. 3-6. An upper portion of the shaft 803 is connected to an activation shaft 804. The activation shaft 804 extends into a cylindrical extension 805 of the main piston 801. Seals 806, 807 are included to provide for pressure integrity of the bailer piston 209. Piston core rods 808, which are attached to rod extensions 809, are included to ensure that the main piston 801 and the piston core 802 do not part during operation of the bailer 200. Seals 810, 810' are included around the piston core rods 808 to provide for pressure integrity of the bailer piston 209. An equalization channel 811 provides for fluid/pressure communication between the well surroundings and the internal chamber 812 of the cylindrical extension 805. This is required to avoid trapped pressure and/or accidental operation due to temperature effects or similar.

The activation shaft 804 comprises a radial extension 813, as shown in FIG. 8. However, it should be appreciated that more than one radial extension 813 may be provided. The radial extension 813 protrudes, through a longitudinal slot 814 of the cylindrical extension 805, to the main piston 801. When the activation shaft 804 is operated, the radial extensions 813 will push onto a shoulder 815 of the piston core 802.

FIG. 8 also illustrates guide bolts 816 that are attached to the finger couplings 212. The guide bolts 816 have a certain degree of freedom with respect to longitudinal movement inside recesses 817 of the piston core 802. More precisely, the guide bolts 816 are arranged to move freely between an upper surface 818 and a lower surface 819 of the recess 817.

The embodiment of the bailer piston 209, which is illustrated in FIG. 8, may also include springs or shear pins in order to bias or fix the activation shaft 804 towards a lower position in the bailer for the initial positioning and during deployment, hence preventing accidental activation prior to and during lowering of the bailer into the debris column. Preferably, a correct choice of shear pin strength and/or spring force in this relation is adapted to the relevant fluids and debris (compactness of debris) in the well. This would be appreciated by a person skilled in the art and is therefore not discussed in any further detail herein.

Figure 9:
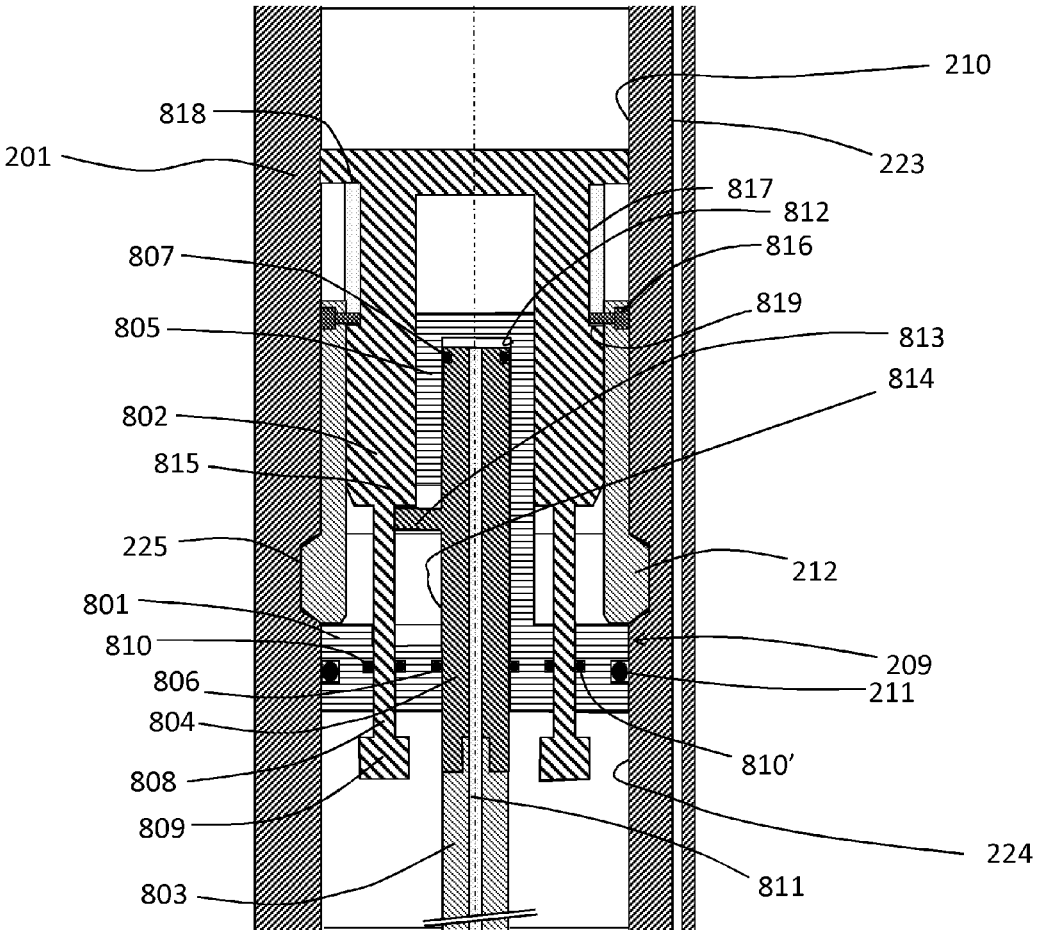
Figure 10:
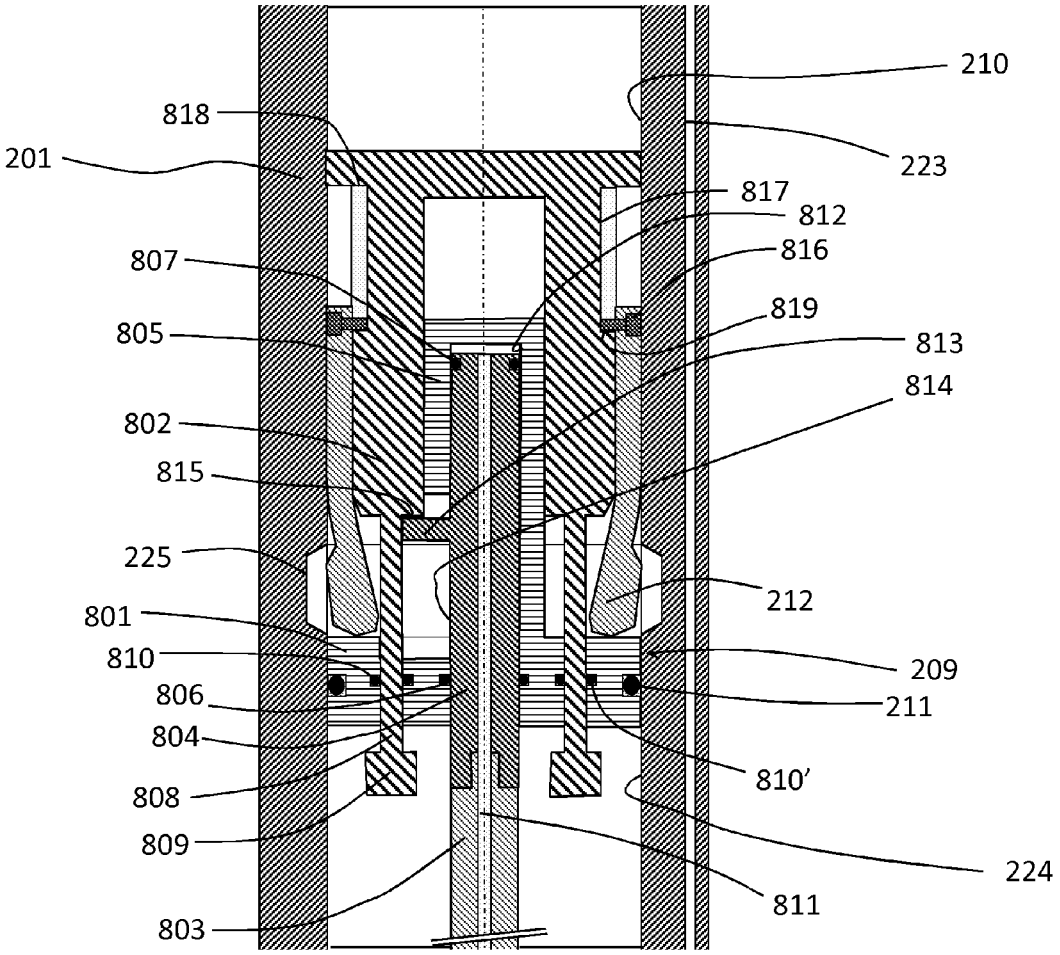
Figure 11:
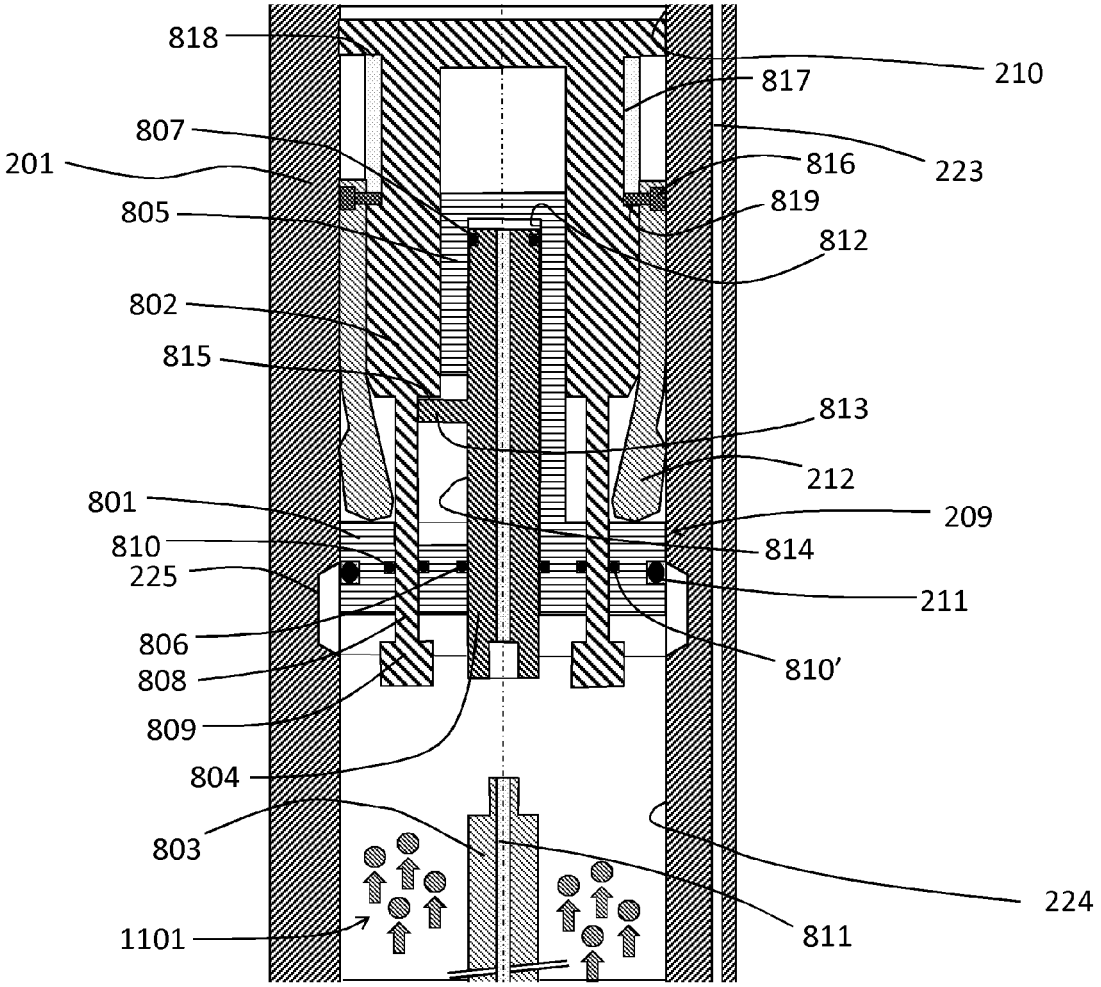
Figure 12:
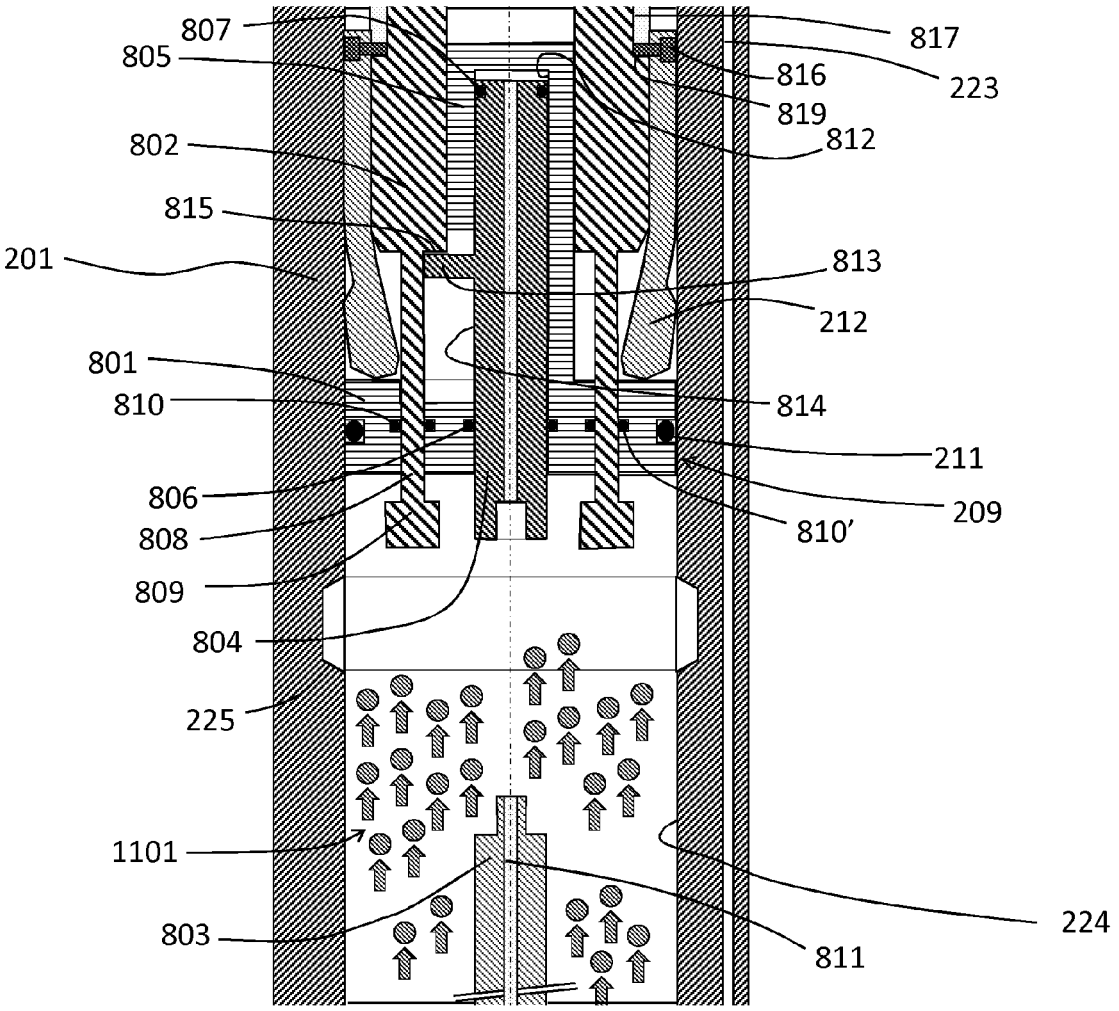

FIG. 9 illustrates the first operational step for the embodiment discussed in FIG. 8. As a result of lowering the activation nose 215, as shown e.g. in FIG. 4, into a debris column (not shown), this ultimately shifts the activation shaft 804 upwards. This again causes the radial extension 813 to push the piston core 802 upwards accordingly. When the piston core has travelled a certain distance, the finger coupling 212 will lose its radial support, and subsequently disengage from the recess 225. This is illustrated in FIG. 10. When the finger coupling 212 disengages from the recess 225, the bailer piston 209 will be pushed upwards in the collector chamber 210 of the bailer 200. This is illustrated in FIG. 11 and further in FIG. 12. As a consequence of the pressure surge created, debris 1101 is sucked into the bailer 200, more precisely into a cavity 224 between the piston 209 and a lower flange (not shown) similar to lower flange 201, shown e.g. in FIGS. 3-6.

FIG. 13 illustrates a further alternative embodiment of the bailer piston 209 and related design and philosophy of operation. A shaft 1301 is in direct connection with the activation nose (not shown), which is similar to the activation nose 215 shown in e.g. FIG. 4. The shaft 1301 extends into a cylindrical extension 805 of the main piston 801. Initially, seals 1302, 1303 on a radial extension of shaft the 1301 seals off a port 1304 in the cylindrical extension 805 of the main piston 801. The port 1304 is in fluid communication with a chamber 1305, which again is in fluid communication with a chamber 817. In this embodiment, the piston core 802 has been provided with a top seal 1306.

Figure 14:
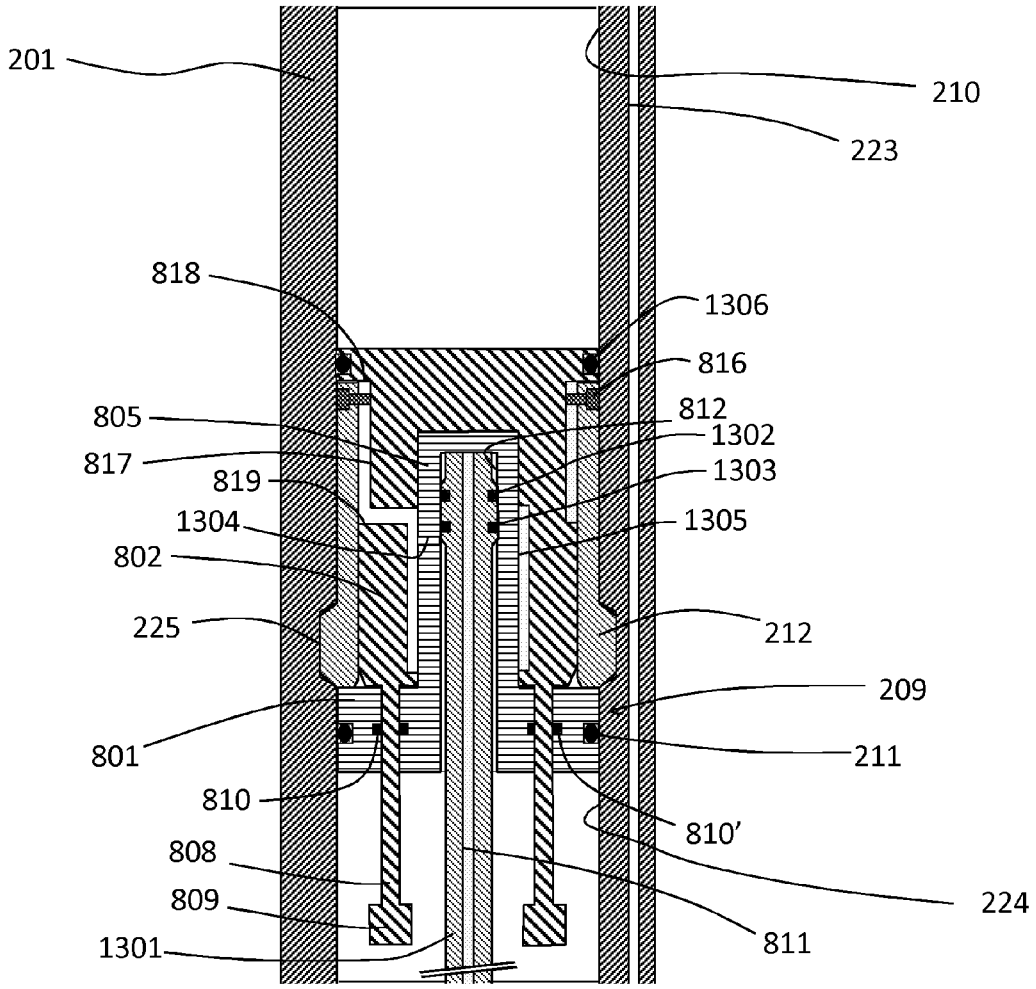

FIG. 14 illustrates a first step of operating the system according to the embodiment shown in FIG. 13. When the activation nose is lowered into the debris (as shown in FIG. 4), the shaft 1301 is pushed upwards and into the bailer 200. More precisely, the shaft 1301 is displaced into the cavity 812, which is best seen in FIG. 13. This displacement results in the port 1304 becoming exposed to well pressure. Because of the somewhat slimmer design of the shaft 1301 below the radial extension housing seals 1302, 1303, the fluid communication is good, and the internals of the bailer piston 209, such as the chamber 1305 and the chamber 817, are quickly filled with high-pressure fluids.

Figure 15:
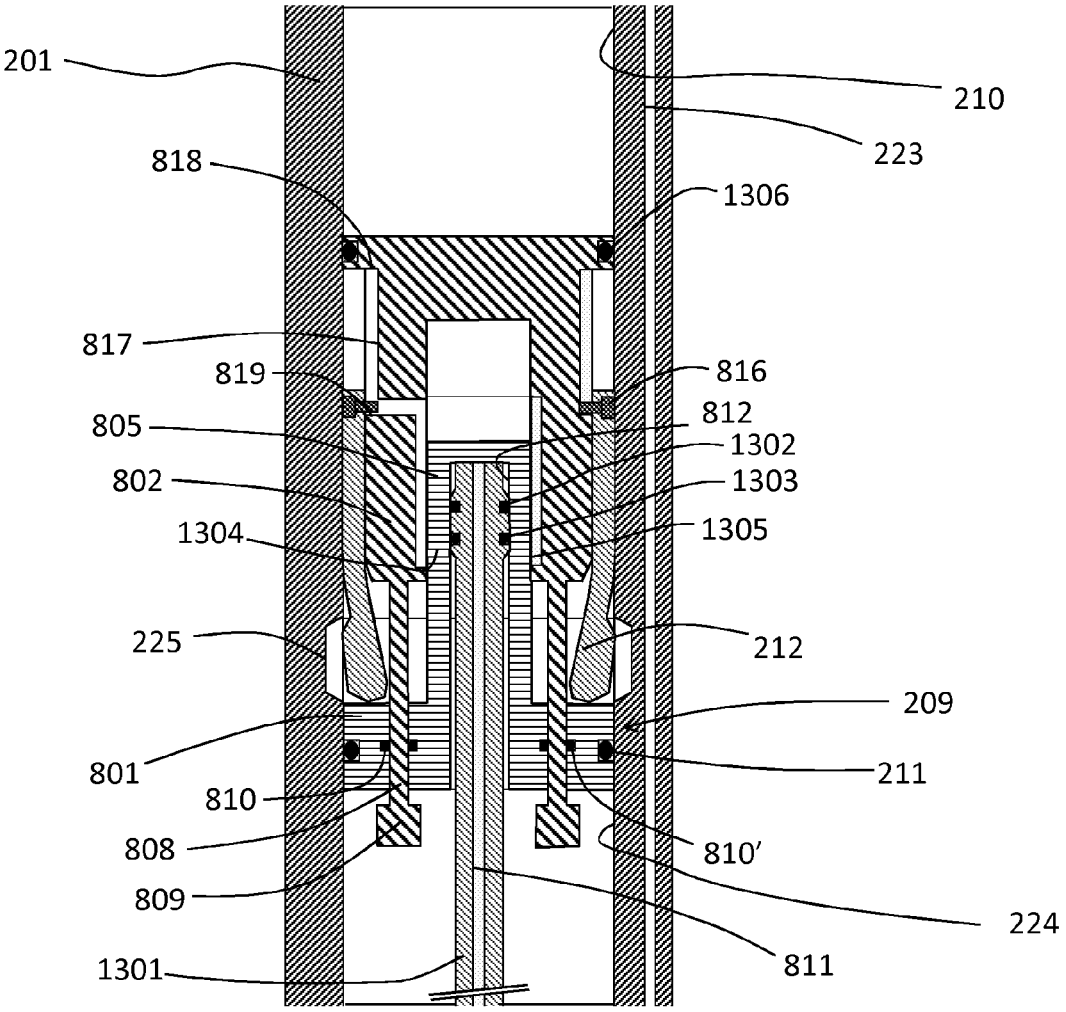
Figure 16:
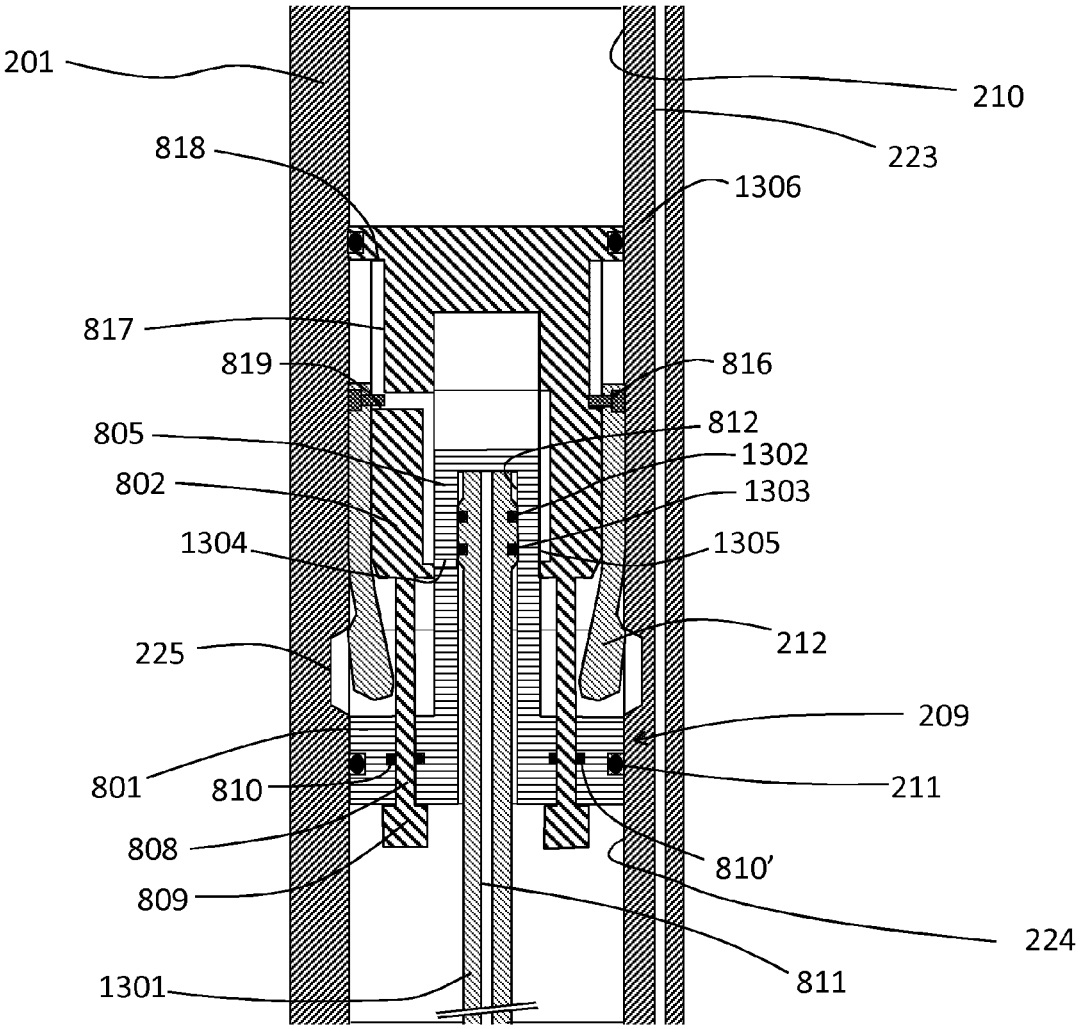
Figure 17:
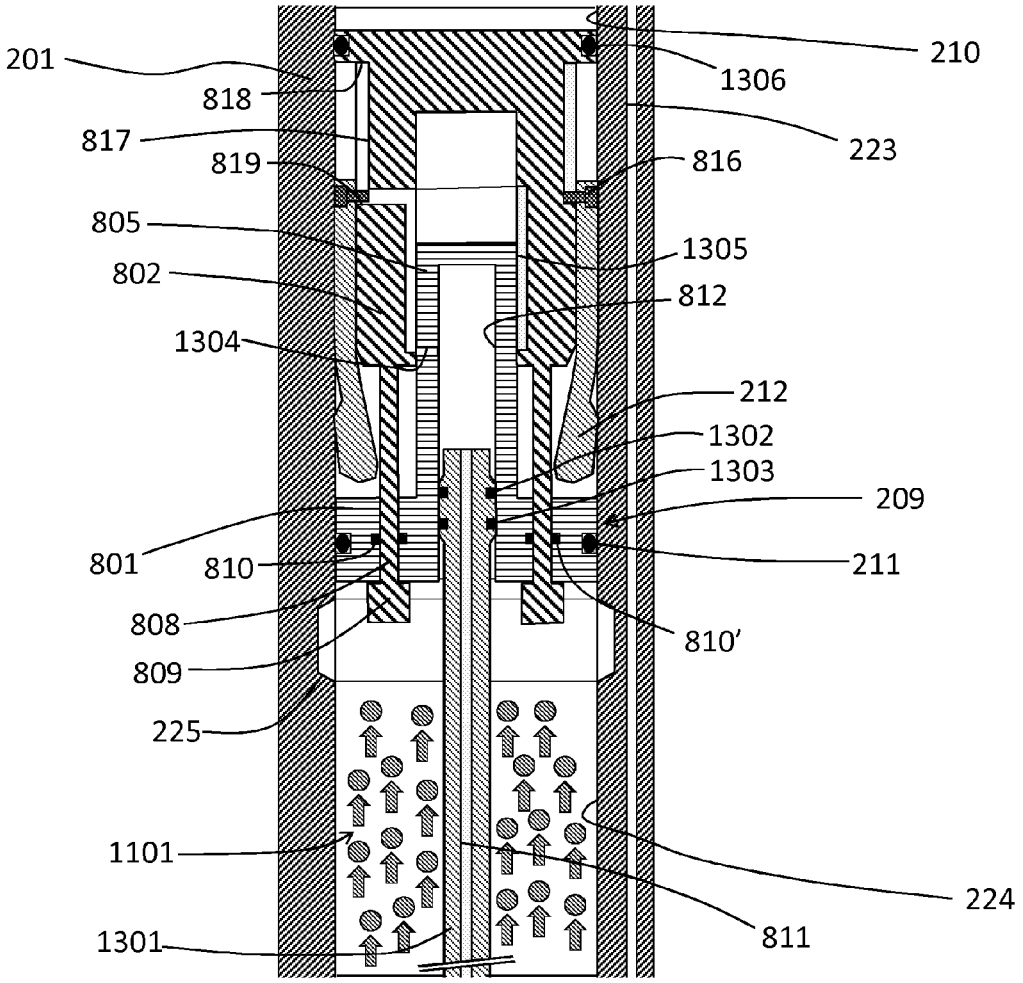

As illustrated in FIG. 15, the entry of high pressurized fluids into the bailer piston 209 causes the piston core 802 to be pushed up and inwards into the evacuated/atmospheric chamber of the bailer 200. This causes the finger coupling 212 to lose its radial support and collapse inwards. Now the bailer piston 209 is released and is free to move inside the collector pipe 201. Due to the atmospheric pressure conditions in the cavity 210, the piston is forced into this cavity by the well pressure. Subsequent to this, debris is sucked into the bailer 200 from the low side. This is further illustrated in FIGS. 16 and 17.

FIG. 18 shows yet another embodiment of the present invention. Here, the bailer 200 is run into the well on a wireline tool 1801, such as a wireline tractor. The wireline tool 1801 is connected to the bailer 200 via a crossover device 1802. For this embodiment, the bailer 200 is activated by means of a control signal and/or action, such as an electric signal and/or action. FIG. 18 illustrates an electric activation system. Here, the top section of the bailer 200 comprises an electric connector plug 1803. In one embodiment, this electric connector plug 1803 also functions as a pressure barrier in order to protect delicate components inside the wireline tool 1801 and the crossover 1802 from being exposed to high pressure after activating the bailer 200. An electric cable/lead 1804 runs from the electric connector plug 1803, through the majority of the collector pipe 201 of the bailer 200 and terminates in an electrically-operated version of the activation mechanism 214.

A main benefit with electric activation is that the bailer 200 can be controlled by an operator. Considering the scenario from FIG. 2, where debris may have formed a long dune or accumulation, it may be beneficial to use a wireline tractor to "shovel" or compress the dune 112 into a larger and more compact debris column prior to activating the bailer 200. A system that operates on impact may trigger too early or too late, which may result in a somewhat non-optimal debris collection process, whereas an operator-controlled system allows for a far better collection pattern for such scenarios.

FIG. 19 illustrates one example of electric activation, wherein the main piston 801 and the piston core 802 are locked together by means of lock fingers 1901 attached to the main piston by means of bolts 1902. When the bailer 200 is in its initial position, the lock fingers 1901 are radially supported by a radial extension 1903 that forms an integrated part of a shaft 1904. In this embodiment, the main piston 801 and the piston core 802 include a pre-compressed spring 1914 that seeks to push the piston core 802 upwards/inwards into the bailer 200, hence away from the main piston 801. The shaft 1904 also includes a flange 1905. An initially pre-compressed spring 1906 seeks to push the flange 1905, and thereby the shaft 1904, downwards with respect to a flange housing 1910. A set of lock profiles 1907 locks the shaft 1904 in its initial position, as the lower part of the lock profiles 1907 engage in a lock groove 1908 provided in the shaft 1904. In this embodiment, the lock profiles 1907 comprise at least two elements that form, when assembled, a cylindrical shape. Also, the lock profiles 1907 are kept in their initial assembled cylindrical shape by means of a fuse wire 1909 wrapped around the lock profiles 1907 forming a cylindrical assembly. The fuse wire 1909 is connected to the electric lead 1804. The lower end of the lock profiles 1907 rests against a top shoulder of the flange housing 1910, which is attached to the main piston 801 via connector shafts 1911. The connector shafts 1911 are fixed to the main piston 801 by a fixing means, such as a threaded connection or by other suitable fixing means that will be appreciated by a person skilled in the art. In the embodiment shown, lock nuts 1912 are used as fastening means to fasten the flange housing 1910 to the connector shafts 1911.

For the embodiment illustrated in FIG. 19, the main piston 801 has been designed with a swab cup stack 1913 as a supplement to the seal 211. Normally, the swab cup stack 1913 will have better sealing capabilities during the dynamic part of the bailer 200 operation, i.e. when the main piston 801 is moving, thereby providing the best possible optimization of the debris collecting process.

Figure 20:
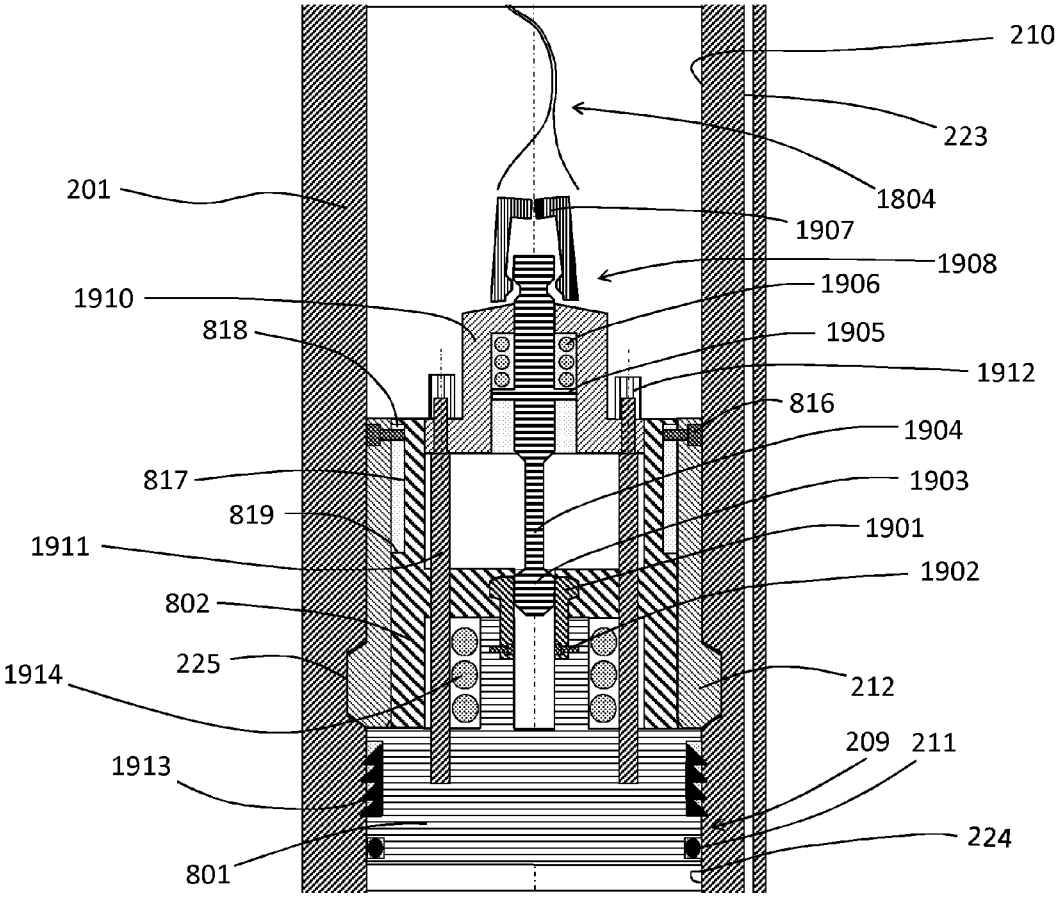

FIG. 20 illustrates a first step of the operation where an electric current has been applied on the electric lead 1804. This has caused the fuse wire 1909 (shown in FIG. 19) to burn up or at least degrade to a level where the compressed spring 1906 can overcome the holding force exerted by lock profiles 1907 on the lock groove 1908 of the shaft 1904. As a result, the shaft 1904 is free to move down, pushed by the spring 1906 exerting force on the flange 1905. In FIG. 20 the fuse wire 1809 has been burned up, hence is not shown.

Figure 21:
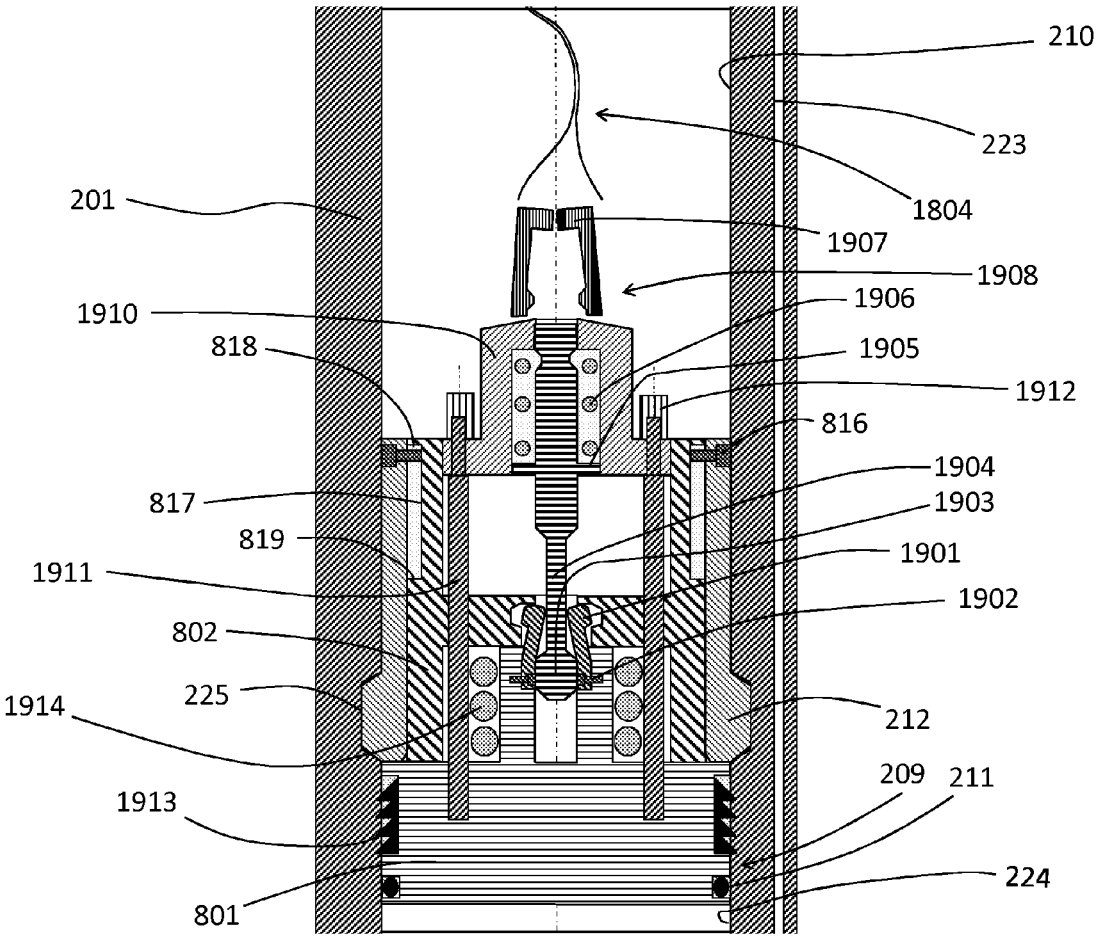

FIG. 21 illustrates the next step where the shaft 1904 is shifted down whereby the radial extension 1903 no longer supports the lock fingers 1901 radially. Hence, the lock fingers 1901 disengage from the recesses and do no longer lock the main piston 801 and the piston core 802 together.

Figure 22:
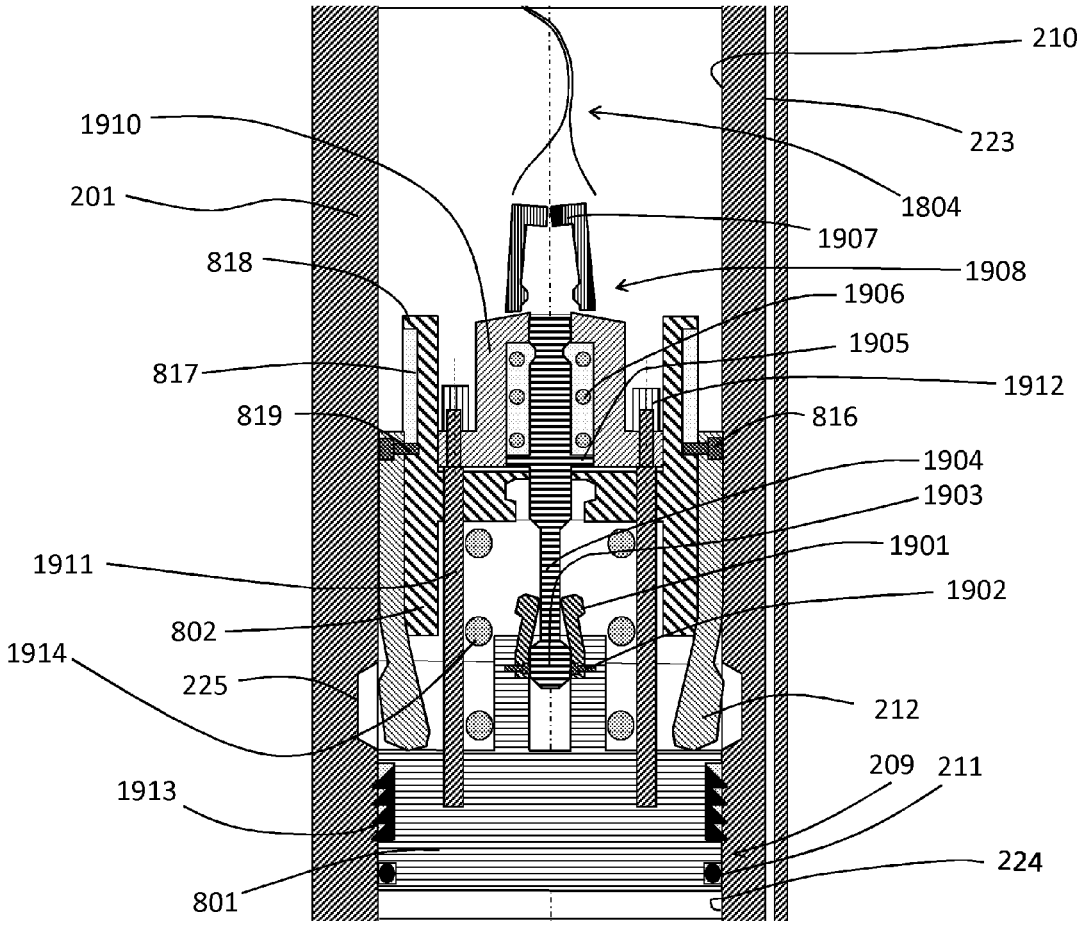
Figure 23:
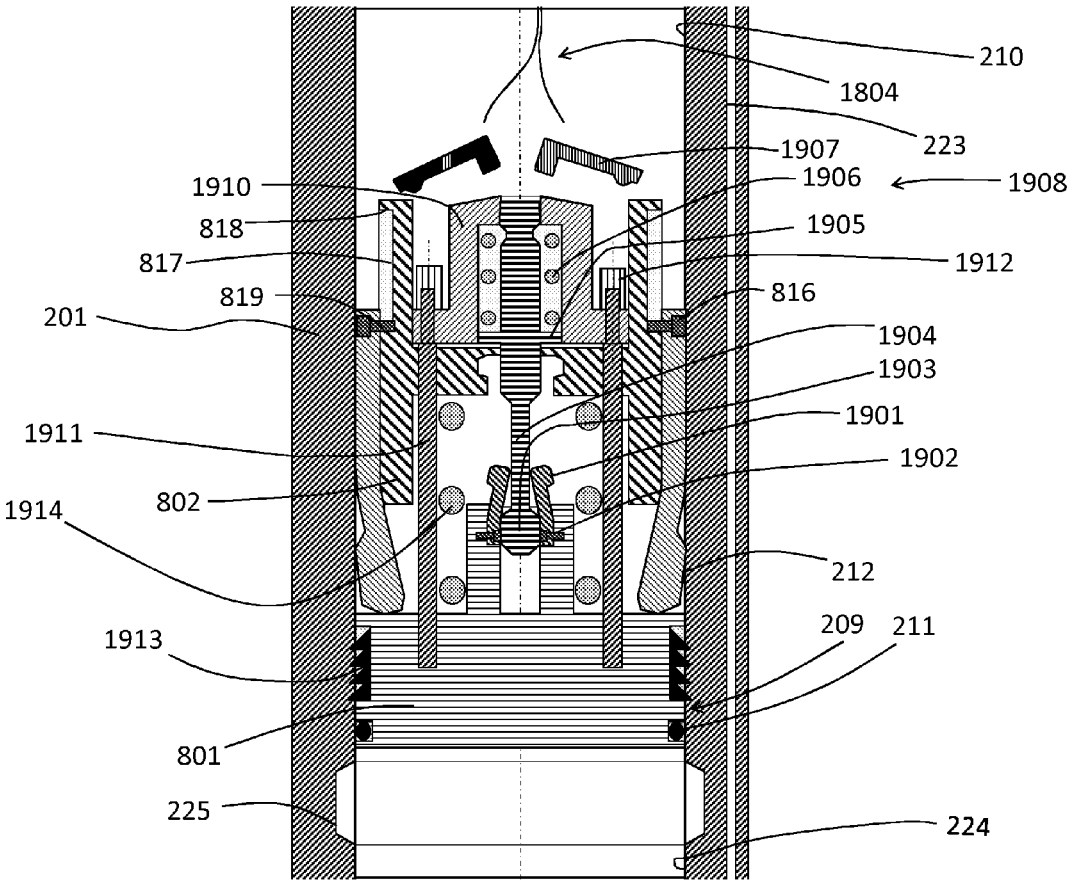

Now, as illustrated in FIG. 22, the spring 1914 pushes the piston core 802 up/inwards into the bailer 200. As a consequence, piston core 802 no longer supports the finger coupling 212 radially. The plug 209 then releases, as described in relation to explanations given for previously described embodiments herein. This is further illustrated in FIG. 23.

FIG. 24 illustrates an alternative way of effectuating operator-controlled electric activation of the bailer 200. Initially, the cylindrical lock profile 1907 assembly is held in place by a lock cylinder 2401. The lock cylinder 2401 is attached to a motor shaft 2402 that runs through an electro-motor 2403. The motor 2403 is connected to a motor flange 2404 bolted to a motor support housing 2406 via bolts 2405. The motor support housing 2406 is bolted to the flange housing 1910 via bolts 2407. By so doing, the motor assembly is fixed directly to the main piston 801.

FIG. 25 illustrates the initial step of operation for this embodiment. Here, an operator command/action is applied to operate the motor 2403. This again ensures that the lock cylinder 2401 is pulled up so that the lock profiles 1907 become unsupported. As described for the previous embodiment shown in FIGS. 19-24, this triggers a cascade of events that results in the bailer 200 becoming activated.

FIG. 26 illustrates an embodiment where the bailer 200 is provided with a chamber 2601 for containing a fluid under high pressure. For example, the fluid may be a gas, but it may also, or alternatively, be a liquid. For this embodiment, in conjunction with the operation of the bailer 200 itself, a valve 2602 is also operated, whereby high pressure fluid flows down the equalizing line 223. For the given embodiment, the valve 2602 is operated electrically via a cable 2603, but other means known per se of achieving valve 2602 operation may also be applied. A benefit of using a high pressurized fluid, as described herein, is that this will contribute to prevent the bailer 200 from sinking significantly into the column of debris 111 during the operation. Provided a correctly tuned flow capacity of the equalizing line 223 exists, the highly pressurized fluid allow the bailer 200 to be pushed gradually out of the debris 111 column after the operation. In the embodiment shown, the chamber 2601 may be filled with the fluid via the equalizing line 223.

FIG. 27 illustrates, in larger scale, a second scenario of applying a highly pressurized gas. The figure illustrates sections of a wireline tool 2701 used to retrieve the bailer 200 in case it should become stuck in the debris 111. This may occur if the equalizing line 223 becomes accidentally plugged prior to operating the bailer 200. To remedy such a situation, the wireline tool 2701 is lowered onto the top flange 203 of the bailer 200, as illustrated in previous figures such as FIG. 26, whereby a skirt with elastomeric seals 2702 enters and forms a sealing connection against the top flange 203. Systems for anchoring the wireline tool 2701 mechanically to the flange 203 might be included, but are not shown in the figure. Upon verifying a proper connection, a valve 270 inside the wireline tool 2701 is opened so as to allow highly pressurized fluid, for example a gas from a chamber 2703 in the wireline tool 2701, to be released and flow down the equalization line 223. This will cause a high pressure to form at the base of the bailer 200, which facilitates retrieval of the bailer 200 as the high pressure pushes the bailer 200 up from the lowered position in the debris column 111.

FIGS. 28*a* and 28*b* illustrate, in larger scale, a lower portion of the bailer 200 being provided with means 2801, 2802 for preventing the equalizing line 223 from becoming accidentally plugged during intervention and/or operation in the well. Such features will be part of a preferred embodiment, given that any accidental plugging of the line 223 is highly undesirable. FIG. 28*a* illustrates the use of a check valve 2801 to prevent the line 223 from getting plugged. FIG. 28*b* illustrates the use of a plug 2802, such as a plug made of an elastomeric material, for plugging off the line 223. Upon activation of the bailer 200, the check valve 2801 will be forced open, and/or the plugs 2802 will be blown out from the line 223, due to the relative high pressure emerging from the top end of the bailer and down via line 223, which ensures that the line 223 remains free from impurities until the bailer 200 is activated, whereupon the line is opened to allow for fluid flow from the top section of the bailer 200 to the bottom section of the bailer 200.

While the invention has been described with a certain degree of particularity, many changes may be made in the details of construction and the arrangement of components without departing from the spirit and scope of this disclosure. It is understood that the invention is not limited to the embodiments set forth herein for purposes of exemplification, but is limited only by the scope of the attached claims, including the full range of equivalency to which each element thereof is entitled.

The invention claimed is:

1. An apparatus (200) for collecting debris (111) in a wellbore, the apparatus comprising:

a housing (201, 202, 203) for receiving debris (111), the housing (201, 202, 203) being defined by an endless wall portion (201), a first end portion (203) and a second end portion (202), at least the second end portion (202) being provided with at least one closable aperture (204) allowing one-way flow of debris into the housing;

a releasable sealing device (209) for holding a volume of a first fluid within the housing (201, 202, 203), the volume of the first fluid having a lower pressure than ambient wellbore pressure;

a retaining device (212, 213) for initially holding the releasable sealing device (209) in a first position;

a release mechanism (214, 215) for operating the retaining device (212, 213) in a manner allowing the releasable sealing device (209) to move from the first position to a second position, whereby debris is entered through the at least one closable aperture (204) into the housing, whereupon said volume of first fluid is reduced; and at least one conduit (223) extending between and through the first and second end portions (202, 203) of the apparatus, the conduit (223) being configured to communicate wellbore fluid from an outside of the first end portion (203) to an outside of the second end portion (202) to equalize any pressure differential between the outside of the first and second end portions (202, 203).

2. The apparatus (200) according to claim 1, wherein the second end portion (203) is comprised by the releasable sealing device (209) and the aperture (204) is defined by the sealing device (209).

3. The apparatus (200) according to claim 2, wherein the releasable sealing device is a piston (209) arranged within the housing (201, 202, 203), the piston (209) defining at least a first chamber (210) within the housing, and a second chamber (224) being in fluid communication with the at least one closable aperture (204).

4. The apparatus (200) according to claim 3, wherein the pressure in the second chamber (224) is higher than the pressure in the first chamber (210) whereby upon operating of the release mechanism, the piston (209) is allowed to move towards the second end portion (203) and allow debris (111) to be moved through the at least one closable aperture (204) into the first chamber (224).

5. The apparatus according to claim 1, wherein the at least one conduit (223) is provided in the wall portion (201).

6. The apparatus according to claim 1, wherein the conduit (223) is provided with means (2801, 2802) arranged in a lower portion of the conduit (223), whereby debris (111) is prevented from entering into the conduit (223) upon running the apparatus (200) into the debris (111).

7. The apparatus according to claim 6, wherein the means (2801, 2802) is a one-way valve.

8. An apparatus (200) for collecting debris (111) in a wellbore, the apparatus comprising:

a housing (201, 202, 203) for receiving debris (111), the housing (201, 202, 203) being defined by an endless wall portion (201), a first end portion (203) and a second end portion (202), at least the second end portion (202) being provided with at least one closable aperture (204) allowing one-way flow of debris into the housing;

a releasable sealing device (209) for holding a volume of a first fluid within the housing (201, 202, 203), the volume of the first fluid having a lower pressure than ambient wellbore pressure;

a retaining device (212, 213) for initially holding the releasable sealing device (209) in a first position;

a release mechanism (214, 215) for operating the retaining device (212, 213) in a manner allowing the releasable sealing device (209) to move from the first position to a second position, whereby debris is entered through the at least one closable aperture (204) into the housing, whereupon said volume of first fluid is reduced; and at least one conduit (223) defined by an inlet and an outlet, the outlet being in the second end portion (202) being submerged in the debris (111) when the apparatus (200) is in a position for collecting debris (111), the inlet being in fluid communication with a pressurised second fluid contained in a chamber (2601), the second fluid having a pressure exceeding an ambient pressure so that, upon release of a valve (2602), the pressurized second fluid flows out of the outlet.

9. The apparatus (200) according to claim 8, wherein the second end portion (203) is comprised by the releasable sealing device (209), and the at least one aperture (204) is defined by the sealing device (209).

10. The apparatus (200) according to claim 9, wherein the releasable sealing device is a piston (209) arranged within the housing (201, 202, 203), the piston (209) defining at least a first chamber (210) within the housing, and a second chamber (224) being in fluid communication with the at least one closable aperture (204).

11. The apparatus (200) according to claim 10, wherein the pressure in the second chamber (224) is higher than the pressure in the first chamber (210) whereby upon operating of the release mechanism, the piston (209) is allowed to move towards the second end portion (203) and allow debris (111) to be moved through the aperture (204) into the first chamber (224).

12. The apparatus according to claim 8, wherein the at least one conduit (223) is provided in the wall portion (201).

13. The apparatus of according to claim 8 wherein the conduit (223) is provided with means (2801, 2802) arranged in a lower portion of the conduit (223), whereby debris (111) is prevented from entering into the conduit (223) upon running the apparatus (200) into the debris (111).

14. The apparatus according to claim 13, wherein the means (2801, 2802) is a one-way valve.

15. A method for facilitating retrieval of an apparatus (200), for collecting debris in a wellbore, the apparatus having a housing defined by an endless wall portion, first and second end portions, at least the second end portion provided with at least one closable aperture allowing one-way flow of debris into the housing, a releasable sealing device for holding a first fluid within the housing, the volume of the first fluid having a lower pressure than ambient wellbore pressure, a retaining device for initially holding the releasable sealing device in a first position, a release mechanism for operating the retaining device in a manner allowing the releasable sealing device to move from the first position to a second position, whereby debris is entered through the closable aperture into the housing, whereupon said volume of first fluid is reduced, and at least one conduit extending between and through the first and second end portions of the apparatus, the conduit being configured to communicate wellbore fluid from an outside of the first end portion to an outside of the second end portion, said method comprising the following step:

allowing pressurized fluid to flow out of a lower portion of the apparatus and into the debris, which at least reduces any underpressure generated during at least one of a debris collection process and an apparatus retrieval process from the well.

16. A method for facilitating retrieval of an apparatus for collecting debris in a wellbore, the apparatus having a housing for receiving debris and being defined by an endless wall portion, a first end portion and a second end portion, at least the second end portion being provided with at least one closable aperture allowing one-way flow of debris into the housing, a releasable sealing device for holding a volume of a first fluid within the housing, the volume of the first fluid having a lower pressure than the ambient wellbore pressure, a retaining device for initially holding the releasable sealing device in a first position, a release mechanism for operating the retaining device in a manner allowing the releasable sealing device to move from the first position to a second position, whereby debris is entered through the closable aperture into the housing, whereupon said volume of first fluid is reduced, at least one conduit defined by an inlet and an outlet, the outlet being in the second end portion being submerged in the debris when the apparatus is in a position for collecting debris, the inlet being in fluid communication with a pressurised second fluid contained in a chamber, the second fluid having a pressure exceeding an ambient pressure so that, upon release of a valve, the pressurized second fluid flows out of the outlet, said method comprising the following step:

allowing pressurized fluid to flow out of a lower portion of the apparatus and into the debris, which at least reduces any underpressure generated during at least one of a debris collection process and an apparatus retrieval process from the well.

* * * * *